US007641623B2

(12) United States Patent
Biondo et al.

(10) Patent No.: US 7,641,623 B2
(45) Date of Patent: Jan. 5, 2010

(54) SYSTEM FOR COMPRESSION THERAPY WITH PATIENT SUPPORT

(75) Inventors: John P. Biondo, Aurora, IN (US); Catherine A. Pietsch, Mt. Pleasant, SC (US); Michael Z. Sleva, Cincinnati, OH (US); Gregory W. Branson, Batesville, IN (US); Jeffrey S. Lockwood, Batesville, IN (US); Rachel Elizabeth Hopkins, Covington, KY (US); Todd P. O'Neal, Fairfield, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 686 days.

(21) Appl. No.: 10/553,086

(22) PCT Filed: Apr. 8, 2004

(86) PCT No.: PCT/US2004/010808

§ 371 (c)(1),
(2), (4) Date: Oct. 11, 2005

(87) PCT Pub. No.: WO2004/091463

PCT Pub. Date: Oct. 28, 2004

(65) Prior Publication Data

US 2006/0258964 A1 Nov. 16, 2006

Related U.S. Application Data

(60) Provisional application No. 60/462,130, filed on Apr. 11, 2003.

(51) Int. Cl.
*A61H 23/04* (2006.01)
*A61H 15/00* (2006.01)

(52) U.S. Cl. ..... 601/149; 601/152; 125/845

(58) Field of Classification Search ..... 601/24, 601/86, 90, 98, 148–152; 128/DIG. 20, 845
See application file for complete search history.

(56) References Cited

U.S. PATENT DOCUMENTS 891,181 A 6/1908 Mitchell
RE14,681 E 7/1919 Faries (Continued)

FOREIGN PATENT DOCUMENTS

EP 0 861 651 A1 9/1998

(Continued)

*Primary Examiner*—Danton DeMille
(74) *Attorney, Agent, or Firm*—Barnes & Thornburg LLP

(57) ABSTRACT

A system for compression therapy comprises a patient-support apparatus and a compression sleeve assembly that is coupleable to the patient-support apparatus. In some embodiments, the patient-support apparatus comprises a hospital bed; and in other embodiments, the patient-support apparatus comprises a mattress for a bed. The compression sleeve assembly comprises a sleeve that couples to a patient's limb and that inflates to promote blood flow. The compression sleeve assembly also comprises a conduit and a compression module that is operable to inflate the sleeve through the conduit. The conduit may be routed, at least in part, through the associated patient-support apparatus. The compression module may be situated, at least in part, in a cavity of the associated patient-support apparatus. A compression module that couples to an architectural structure, such as a headwall unit, is also disclosed.

28 Claims, 13 Drawing Sheets

U.S. PATENT DOCUMENTS

| | | | | |
|---|---|---|---|---|
| 1,608,239 | A | | 11/1926 | Rosett |
| 2,361,242 | A | | 10/1944 | Rosett |
| 2,531,074 | A | | 11/1950 | Miller |
| 2,533,504 | A | | 12/1950 | Poor |
| 2,699,165 | A | | 1/1955 | Ferrier |
| 2,781,041 | A | | 2/1957 | Weinberg |
| 2,823,668 | A | | 2/1958 | van Court et al. |
| 2,880,721 | A | | 4/1959 | Corcoran |
| 2,896,612 | A | | 7/1959 | Bates et al. |
| 2,943,859 | A | | 7/1960 | Koski et al. |
| 3,094,116 | A | | 6/1963 | Logan et al. |
| 3,094,118 | A | | 6/1963 | De Besme et al. |
| 3,177,866 | A | | 4/1965 | Wesslund |
| 3,186,405 | A | | 6/1965 | Bailey et al. |
| 3,454,010 | A | | 7/1969 | Lilligren et al. |
| 3,548,809 | A | | 12/1970 | Conti |
| 3,811,431 | A | | 5/1974 | Apstein |
| 3,831,766 | A | | 8/1974 | Newman et al. |
| 3,865,102 | A | | 2/1975 | Birtwell et al. |
| 3,866,604 | A | * | 2/1975 | Curless et al. ..... 601/152 |
| 3,868,952 | A | | 3/1975 | Hatton |
| 3,880,149 | A | | 4/1975 | Kawaguchi |
| 3,889,494 | A | | 6/1975 | Patience et al. |
| 3,892,229 | A | | 7/1975 | Taylor et al. |
| 3,896,794 | A | | 7/1975 | McGrath |
| 3,901,225 | A | | 8/1975 | Sconce |
| 3,982,531 | A | | 9/1976 | Shaffer |
| 4,013,069 | A | | 3/1977 | Hasty |
| 4,021,860 | A | | 5/1977 | Swallow et al. |
| 4,027,667 | A | | 6/1977 | Swallow et al. |
| 4,029,087 | A | | 6/1977 | Dye et al. |
| 4,030,488 | A | | 6/1977 | Hasty |
| 4,054,952 | A | | 10/1977 | Swallow |
| 4,069,515 | A | | 1/1978 | Swallow et al. |
| 4,089,068 | A | | 5/1978 | Swallow |
| 4,091,804 | A | | 5/1978 | Hasty |
| 4,156,425 | A | | 5/1979 | Arkans |
| 4,157,713 | A | | 6/1979 | Clarey |
| 4,180,869 | A | | 1/1980 | Pedergrass et al. |
| 4,198,961 | A | | 4/1980 | Arkans |
| 4,202,325 | A | | 5/1980 | Villari et al. |
| 4,207,875 | A | | 6/1980 | Arkans |
| 4,207,876 | A | | 6/1980 | Annis |
| 4,253,449 | A | | 3/1981 | Arkans et al. |
| 4,280,485 | A | | 7/1981 | Arkans |
| 4,311,135 | A | | 1/1982 | Brueckner et al. |
| 4,320,746 | A | | 3/1982 | Arkans et al. |
| 4,331,133 | A | | 5/1982 | Arkans |
| 4,335,726 | A | | 6/1982 | Kolstedt |
| 4,369,588 | A | | 1/1983 | Berguer |
| 4,370,975 | A | | 2/1983 | Wright |
| 4,372,297 | A | | 2/1983 | Perlin |
| 4,374,518 | A | | 2/1983 | Villanueva |
| 4,375,217 | A | | 3/1983 | Arkans |
| 4,388,923 | A | | 6/1983 | Heimreid |
| 4,396,010 | A | | 8/1983 | Arkans |
| 4,402,312 | A | | 9/1983 | Villari et al. |
| 4,418,690 | A | | 12/1983 | Mummert |
| 4,424,596 | A | | 1/1984 | Jackson |
| 4,453,538 | A | | 6/1984 | Whitney |
| 4,481,937 | A | | 11/1984 | Arkans |
| 4,492,234 | A | | 1/1985 | Arkans |
| 4,502,301 | A | | 3/1985 | Swallow et al. |
| 4,513,740 | A | | 4/1985 | Westlake |
| 4,527,402 | A | | 7/1985 | Swallow et al. |
| 4,573,453 | A | | 3/1986 | Tissot |
| 4,577,626 | A | | 3/1986 | Marukawa et al. |
| 4,597,384 | A | | 7/1986 | Whitney |
| 4,614,179 | A | | 9/1986 | Gardner et al. |
| 4,614,180 | A | | 9/1986 | Gardner et al. |
| 4,624,244 | A | | 11/1986 | Taheri |
| 4,628,911 | A | | 12/1986 | Bornstein |
| 4,648,392 | A | | 3/1987 | Cartier et al. |
| 4,657,003 | A | | 4/1987 | Wirtz |
| 4,682,588 | A | | 7/1987 | Curlee |
| 4,696,289 | A | | 9/1987 | Gardner et al. |
| 4,702,232 | A | | 10/1987 | Gardner et al. |
| 4,721,101 | A | | 1/1988 | Gardner et al. |
| 4,722,332 | A | | 2/1988 | Saggers |
| 4,730,610 | A | | 3/1988 | Graebe |
| 4,744,391 | A | | 5/1988 | Lardner |
| 4,745,917 | A | | 5/1988 | Hasty et al. |
| 4,753,226 | A | | 6/1988 | Zheng et al. |
| 4,773,397 | A | | 9/1988 | Wright et al. |
| 4,793,328 | A | | 12/1988 | Kolstedt et al. |
| 4,804,208 | A | | 2/1989 | Dye |
| 4,805,601 | A | | 2/1989 | Eischen, Sr. |
| 4,809,684 | A | | 3/1989 | Gardner et al. |
| 4,827,912 | A | | 5/1989 | Carrington et al. |
| 4,832,010 | A | | 5/1989 | Lerman |
| RE32,939 | E | | 6/1989 | Gardner et al. |
| RE32,940 | E | | 6/1989 | Gardner et al. |
| 4,841,956 | A | | 6/1989 | Gardner et al. |
| 4,846,160 | A | | 7/1989 | Gardner et al. |
| 4,858,596 | A | | 8/1989 | Kolstedt et al. |
| 4,865,020 | A | | 9/1989 | Bullard |
| RE33,090 | E | | 10/1989 | Berguer |
| 4,922,893 | A | | 5/1990 | Wright et al. |
| 4,928,674 | A | | 5/1990 | Halperin et al. |
| 4,938,208 | A | | 7/1990 | Dye |
| 4,941,458 | A | | 7/1990 | Taheri |
| 4,945,905 | A | | 8/1990 | Dye et al. |
| 4,947,834 | A | | 8/1990 | Kartheus et al. |
| 4,966,396 | A | | 10/1990 | Dye |
| 4,971,044 | A | | 11/1990 | Dye |
| 4,989,589 | A | | 2/1991 | Pekanmaki et al. |
| 5,000,164 | A | | 3/1991 | Cooper |
| 5,005,567 | A | | 4/1991 | Gilman et al. |
| 5,007,411 | A | | 4/1991 | Dye |
| 5,014,681 | A | | 5/1991 | Heeman et al. |
| 5,022,387 | A | | 6/1991 | Hasty |
| 5,025,781 | A | | 6/1991 | Ferrari |
| 5,027,797 | A | | 7/1991 | Bullard |
| 5,031,604 | A | | 7/1991 | Dye |
| 5,074,285 | A | | 12/1991 | Wright |
| 5,080,089 | A | | 1/1992 | Mason et al. |
| 5,109,832 | A | | 5/1992 | Proctor et al. |
| 5,117,812 | A | | 6/1992 | McWhorter |
| 5,125,400 | A | | 6/1992 | Johnson, Jr. |
| 5,127,808 | A | | 7/1992 | Nichols et al. |
| 5,133,199 | A | | 7/1992 | Parikh et al. |
| 5,135,473 | A | | 8/1992 | Epler et al. |
| 5,139,479 | A | | 8/1992 | Peters |
| 5,176,624 | A | | 1/1993 | Kuehnreich |
| 5,179,941 | A | | 1/1993 | Siemssen et al. |
| 5,186,163 | A | | 2/1993 | Dye |
| 5,211,162 | A | | 5/1993 | Gillen, Jr. et al. |
| 5,218,954 | A | | 6/1993 | van Bemmelen |
| 5,226,898 | A | | 7/1993 | Gross |
| 5,263,473 | A | | 11/1993 | McWhorter |
| 5,288,286 | A | | 2/1994 | Davis |
| 5,307,791 | A | | 5/1994 | Senoue et al. |
| RE34,661 | E | | 7/1994 | Grim |
| 5,328,445 | A | | 7/1994 | Spahn et al. |
| 5,342,285 | A | | 8/1994 | Dye |
| 5,354,260 | A | | 10/1994 | Cook |
| 5,368,034 | A | | 11/1994 | Isner |
| 5,368,547 | A | | 11/1994 | Polando |
| 5,383,894 | A | | 1/1995 | Dye |
| 5,389,065 | A | | 2/1995 | Johnson, Jr. |
| 5,396,896 | A | | 3/1995 | Tumey et al. |
| D357,736 | S | | 4/1995 | Dye |
| D358,216 | S | | 5/1995 | Dye |
| 5,413,142 | A | | 5/1995 | Johnson et al. |

| | | | | |
|---|---|---|---|---|
| 5,435,009 | A | | 7/1995 | Schild et al. |
| 5,437,610 | A | | 8/1995 | Cariapa et al. |
| 5,441,533 | A | | 8/1995 | Johnson et al. |
| 5,443,440 | A | | 8/1995 | Tumey et al. |
| 5,449,379 | A | | 9/1995 | Hadtke |
| D363,988 | S | | 11/1995 | Dye |
| D364,459 | S | | 11/1995 | Dye |
| D364,460 | S | | 11/1995 | Dye |
| D364,680 | S | | 11/1995 | Dye |
| 5,464,385 | A | | 11/1995 | Grim |
| 5,466,250 | A | | 11/1995 | Johnson, Jr. et al. |
| 5,478,119 | A | | 12/1995 | Dye |
| D367,115 | S | | 2/1996 | Barber et al. |
| 5,490,820 | A | * | 2/1996 | Schock et al. ..... 601/41 |
| 5,496,262 | A | | 3/1996 | Johnson, Jr. et al. |
| D369,664 | S | | 5/1996 | Dye |
| D373,192 | S | | 8/1996 | Murphy et al. |
| 5,558,627 | A | | 9/1996 | Singer et al. |
| D374,931 | S | | 10/1996 | Cesaroni et al. |
| 5,562,091 | A | * | 10/1996 | Foster et al. ..... 128/200.24 |
| D376,013 | S | | 11/1996 | Sandman et al. |
| 5,571,075 | A | * | 11/1996 | Bullard ..... 601/152 |
| 5,575,762 | A | | 11/1996 | Peeler et al. |
| 5,584,798 | A | | 12/1996 | Fox |
| 5,588,954 | A | | 12/1996 | Ribando et al. |
| 5,588,955 | A | | 12/1996 | Johnson, Jr. et al. |
| 5,591,200 | A | | 1/1997 | Cone et al. |
| 5,596,770 | A | | 1/1997 | Kunesh |
| 5,611,096 | A | * | 3/1997 | Bartlett et al. ..... 5/617 |
| 5,613,941 | A | | 3/1997 | Prengler |
| 5,626,556 | A | | 5/1997 | Tobler et al. |
| 5,630,238 | A | | 5/1997 | Weismiller et al. |
| 5,634,889 | A | | 6/1997 | Gardner et al. |
| 5,669,872 | A | | 9/1997 | Fox |
| 5,671,751 | A | | 9/1997 | Tumey et al. |
| 5,674,262 | A | | 10/1997 | Tumey |
| 5,676,639 | A | | 10/1997 | Schild |
| 5,688,225 | A | | 11/1997 | Walker |
| 5,711,760 | A | | 1/1998 | Ibrahim et al. |
| 5,713,954 | A | | 2/1998 | Rosenberg et al. |
| 5,715,548 | A | * | 2/1998 | Weismiller et al. ..... 5/624 |
| 5,725,485 | A | | 3/1998 | Ribando et al. |
| 5,730,136 | A | | 3/1998 | Laufer et al. |
| 5,747,460 | A | | 5/1998 | Bylund et al. |
| 5,769,801 | A | | 6/1998 | Tumey et al. |
| 5,781,949 | A | | 7/1998 | Weismiller et al. |
| 5,783,563 | A | | 7/1998 | Antonsson et al. |
| 5,795,312 | A | | 8/1998 | Dye |
| 5,800,528 | A | | 9/1998 | Lederman et al. |
| 5,810,750 | A | | 9/1998 | Buser |
| 5,826,761 | A | | 10/1998 | Basaj |
| 5,833,711 | A | | 11/1998 | Schneider, Sr. |
| 5,840,049 | A | | 11/1998 | Tumey et al. |
| 5,843,007 | A | | 12/1998 | McEwen et al. |
| 5,865,722 | A | | 2/1999 | Heng |
| 5,868,690 | A | | 2/1999 | Eischen, Sr. |
| 5,876,359 | A | | 3/1999 | Bock et al. |
| 5,891,065 | A | | 4/1999 | Cariapa et al. |
| 5,916,183 | A | | 6/1999 | Reid |
| 5,931,797 | A | | 8/1999 | Tumey et al. |
| 5,938,628 | A | | 8/1999 | Oguri et al. |
| 5,951,502 | A | | 9/1999 | Peeler et al. |
| 5,989,204 | A | | 11/1999 | Lina |
| 6,001,119 | A | | 12/1999 | Hampson et al. |
| 6,010,470 | A | | 1/2000 | Albery et al. |
| 6,022,327 | A | * | 2/2000 | Chang ..... 601/15 |
| 6,036,662 | A | | 3/2000 | Van Brunt et al. |
| 6,047,424 | A | | 4/2000 | Osborne et al. |
| 6,080,120 | A | * | 6/2000 | Sandman et al. ..... 601/152 |
| 6,119,291 | A | | 9/2000 | Osborne et al. |
| 6,129,688 | A | | 10/2000 | Arkans |
| 6,141,792 | A | | 10/2000 | Acker et al. |
| D434,150 | S | | 11/2000 | Tumey et al. |
| 6,149,674 | A | | 11/2000 | Borders |
| 6,171,270 | B1 | | 1/2001 | Gau |
| 6,193,679 | B1 | | 2/2001 | Quinn |
| D439,341 | S | | 3/2001 | Tumey et al. |
| 6,231,532 | B1 | | 5/2001 | Watson et al. |
| 6,249,198 | B1 | | 6/2001 | Clark et al. |
| 6,290,662 | B1 | | 9/2001 | Morris et al. |
| 6,296,617 | B1 | | 10/2001 | Peeler et al. |
| 6,315,745 | B1 | | 11/2001 | Kloecker |
| 6,319,215 | B1 | | 11/2001 | Manor et al. |
| 6,322,530 | B1 | | 11/2001 | Johnson, Jr. et al. |
| 6,355,008 | B1 | | 3/2002 | Nakao |
| 6,358,219 | B1 | | 3/2002 | Arkans |
| 6,361,512 | B1 | | 3/2002 | Mackay et al. |
| 6,368,357 | B1 | | 4/2002 | Schon et al. |
| 6,387,065 | B1 | | 5/2002 | Tumey |
| 6,436,064 | B1 | | 8/2002 | Kloecker |
| 6,440,093 | B1 | | 8/2002 | McEwen et al. |
| 6,447,467 | B1 | | 9/2002 | Barak |
| 6,450,981 | B1 | | 9/2002 | Shabty et al. |
| 6,463,934 | B1 | | 10/2002 | Johnson, Jr. et al. |
| 6,467,111 | B1 | | 10/2002 | Vrzalik et al. |
| 6,468,237 | B1 | | 10/2002 | Lina |
| 6,478,757 | B1 | | 11/2002 | Barak |
| 6,488,643 | B1 | | 12/2002 | Tumey et al. |
| 6,494,852 | B1 | | 12/2002 | Barak et al. |
| 6,544,202 | B2 | | 4/2003 | McEwen et al. |
| 6,551,280 | B1 | | 4/2003 | Knighton et al. |
| 6,558,338 | B1 | | 5/2003 | Wasserman |
| 6,572,621 | B1 | | 6/2003 | Zheng et al. |
| 6,585,669 | B2 | | 7/2003 | Manor et al. |
| 6,589,194 | B1 | | 7/2003 | Calderon et al. |
| 6,589,267 | B1 | * | 7/2003 | Hui ..... 606/202 |
| 6,592,534 | B1 | | 7/2003 | Rutt et al. |
| 6,893,409 | B1 | | 5/2005 | Lina |
| 2001/0011393 | A1 | | 8/2001 | Brooke et al. |
| 2002/0042583 | A1 | | 4/2002 | Barak et al. |
| 2003/0139255 | A1 | | 7/2003 | Lina |

FOREIGN PATENT DOCUMENTS

| | | |
|---|---|---|
| EP | 0 992 230 A2 | 4/2000 |
| JP | 8-38562 | 2/1996 |
| WO | WO 93/12708 | 7/1993 |
| WO | WO 99/11215 | 3/1999 |

* cited by examiner

SYSTEM FOR COMPRESSION THERAPY WITH PATIENT SUPPORT

CROSS-REFERENCE TO RELATED APPLICATIONS

This application is a U.S. national application of International Application Serial No. PCT/US2004/010808 filed Apr. 8, 2004, which claims the benefit under 35 U.S.C. § 119(e) of U.S. Provisional Application Ser. No. 60/462,130 filed Apr. 11, 2003, the complete disclosure of which is hereby expressly incorporated by reference.

BACKGROUND OF THE INVENTION

The present disclosure relates to a system for compression therapy, and particularly to a system for applying compression to one or more of a person's limbs to promote blood flow. More particularly, the present disclosure relates to a compression therapy system having inflatable sleeves that couple to one or more of a person's limbs and that are inflated and deflated to promote blood flow.

Sleeves that couple to a person's limbs and that are inflated to promote blood flow are well known. Such sleeves typically have one or more air bladders and associated hoses or tubes leading from the bladder(s) to a pump unit. Conventional pump units are usually stand-alone units that house a pump or other suitable pressure source along with valves, manifolds, pressure sensors and control circuitry that cooperate with the pump to inflate and deflate the associated bladder(s) according to a control algorithm. These pump units are oftentimes placed on a cabinet or a stand next to a bed or other piece of furniture on which a person rests. In recent times, portable pump units that may be carried by a person during compression therapy have been developed. See, for example, U.S. Pat. Nos. 6,478,757 and 6,447,467, each of which is entitled Device for Pressurizing Limbs. See, also, U.S. Patent Application Publication No. 20020042583A1, which is entitled Automatic Portable Pneumatic Compression System.

SUMMARY OF THE INVENTION

According to the present invention, a system for applying compression therapy to patient's limb is provided and has one or more of the following features or combinations thereof. The system comprises a compression module and a compression sleeve adapted to couple to a patient's limb. The compression module may couple to a patient-support apparatus. The patient-support apparatus may have a module-receiving cavity that receives at least a portion of the compression module. The system may have a conduit extending between the compression module and the compression sleeve. A portion of the conduit may be routed through a portion of the patient-support apparatus. The patient-support apparatus may comprise a bed. The patient-support apparatus may comprise a mattress. The module-receiving cavity may be provided in a siderail of the bed, a foot board of the bed, a deck section of the bed, or in the mattress. The compression module may couple to a headwall unit. The headwall unit may have a module-receiving cavity that receives at least a portion of the compression module. The compression module may have an electric circuit that communicates with a network of a healthcare facility. The electric circuit of the compression module may communicate with the network via an electrical control system of the bed. The electric circuit of the compression module may couple to the network when the compression module is coupled to the headwall.

In some illustrative embodiments, the compression module carries a pressure generator that operates to inflate the compression sleeve through the conduit. In other illustrative embodiments, the compression module couples to an external pressure source and a valve of the compression module is operated to control the application of pressure from the external pressure source to the compression sleeve. In another illustrative embodiment, the compression module carries a pressure generator and also is coupleable to an external pressure source. In this latter embodiment, a control valve may be operated to select whether the compression sleeve is inflated by the pressure generator carried by the compression module or by the external pressure source.

According to an aspect of this disclosure, data is downloaded from the compression module to one or more computer devices of the network and/or software revisions are uploaded to the compression module from one or more computer devices of the network. In some embodiments, the downloading and/or uploading takes place while the compression module is in use and is coupled to the network. In other embodiments, the downloading and/or uploading takes place at a remote location at a later time after use. In some embodiments, a battery of the compression module is recharged while the compression module is coupled to the patient-support apparatus or to the headwall unit. In other embodiments, the compression module is recharged when coupled to a separate recharging apparatus. In one illustrative embodiment, the compression module receives power from a power cord that plugs into a lighter socket of an automotive vehicle.

According to another aspect of this disclosure, a housing of the compression module is configured for portability. For example, different types of handles for carrying the compression module and different types of attachment mechanisms for coupling the compression module to hospital equipment to be transported therewith are disclosed herein. According to a further aspect of this disclosure, different types of garments for carrying the compression module are provided. In some embodiments, the compression sleeve is the garment which carries the compression module.

Additional features will become apparent to those skilled in the art upon consideration of the following detailed description of illustrative embodiments exemplifying the best mode of carrying out various systems for compression therapy as presently perceived.

BRIEF DESCRIPTION OF THE DRAWINGS

The detailed description particularly refers to the accompanying figures, in which.

DETAILED DESCRIPTION OF THE DRAWINGS

Figure 1:
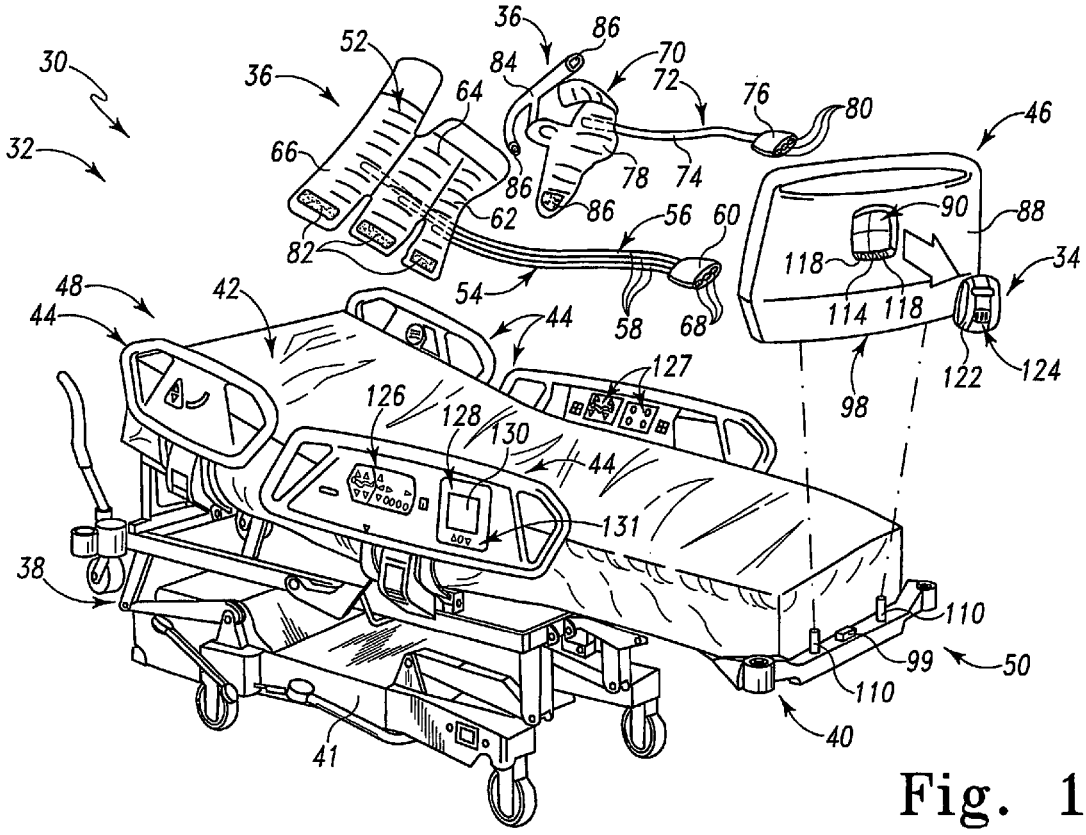
FIG. 1 is a perspective view of a compression therapy system according to this disclosure showing a hospital bed, a footboard of the hospital bed exploded away from a patient-support deck of the hospital bed, a compression module exploded away from a module-receiving cavity formed in the footboard, and a pair of compression sleeves exploded away from the footboard.

One embodiment of a compression therapy system 30 in accordance with this disclosure comprises a patient-support apparatus 32, a compression module 34 that detachably couples to apparatus 32, and one or more compression sleeve assemblies 36 that detachably couple to apparatus 32 as shown in FIG. 1. Illustrative apparatus 32 comprises a hospital bed (sometimes referred to herein as "bed 32") having a frame 38, a patient-support deck 40 coupled to frame 38, a patient-support surface or mattress 42 supported by deck 40, a set of siderails 44 coupled to deck 40, and a footboard 46 that detachably couples to deck 40. Apparatus 32 has a head end 48 and a foot end 50 as shown in FIG. 1. Footboard 46 couples to deck 40 so as to extend upwardly from deck 40 adjacent to foot end 50 of bed 32.

One of illustrative compression sleeve assemblies 36 comprises a sleeve 52 that is sized and configured for attachment to a patient's calf and a conduit 54 that extends from sleeve 52 as shown in FIG. 1. Conduit 54 includes a flexible ribbon 56 of three tubes 58 and a conduit coupler 60 mounted to an end of ribbon 56 that is distal from sleeve 52. Sleeve 52 is subdivided into first, second, and third inflatable portions 62, 64, 66, each of which is associated with a respective tube 58 of ribbon 56. Coupler 60 has three ports 68, each of which communicates pneumatically with a respective tube 58. The other of illustrative compression sleeve assemblies 36 comprises a sleeve 70 that is sized and configured for attachment to a patient's foot and a conduit 72 that extends from sleeve 70 as also shown in FIG. 1. Conduit 72 includes a single, flexible tube 74 and a conduit coupler 76 mounted to an end of tube 74 that is distal from sleeve 70. Sleeve 70 has one inflatable portion 78 which is associated with tube 74. Coupler 76 has three ports 80, two of which are "dummy" ports and one of which communicates pneumatically with tube 74.

Sleeve 52 wraps around and encompasses a patient's calf so that first portion 62 is situated slightly above the patient's ankle and so that portion 66 is situated slightly below the patient's knee. Suitable fasteners 82, such as hook strips that mate with companion loop strips or with an outer layer of material of sleeve 52, are provided for holding sleeve 52 on the patient's calf. Inflatable portion 78 of sleeve 70 wraps around a patient's foot so as to cover the arch, the heel, and the top of the patient's foot. Sleeve 70 also has a strap 84 that is tethered to portion 78 and that wraps around the patient's ankle. Suitable fasteners 86, such as hook strips that mate with companion loop strips or with an outer layer of material of sleeve 70, are provided on portion 78 and on strap 84 for holding sleeve 70 on the patient's foot.

It should be appreciated that assemblies 36 having sleeves 52, 70 are merely a couple of examples of the types of compression sleeve assemblies that may be included in system 30 and therefore, compression sleeves of all shapes, sizes, and types, including sleeves that cover substantially all of a patient's limb and including sleeves having any number of inflatable portions, are within the scope of this disclosure for use in system 30, as are sleeves that slip onto a patient's limb rather than wrap around the patient's limb. Furthermore, in some embodiments, couplers 60, 76 may be omitted such that distal ends of conduits or tubes 58, 74 couple to associated sleeve ports directly.

Illustrative compression module 34 and sleeve assemblies 36 are each coupleable to footboard 46. A front panel or wall 88 of footboard 46 is formed to include a module-receiving cavity 90, shown best in FIG. 1, in which compression module 34 is received when module 34 is coupled to footboard 46. Wall 88 may be formed, such as by molding, with cavity 90 therein or, alternatively, wall 88 may have a substantially planar portion with an opening and a separate piece or pieces that attach to the planar portion to define cavity 90 adjacent the opening.

In the illustrative embodiment, cavity 90 is sized to receive the entire module 34 therein. In alternative embodiments, a smaller cavity is provided in footboard 46 and only a portion of module 34 is received in this alternative cavity. In still further embodiments, no cavity is provided in footboard 46 and module 34 couples to footboard 46 via other mechanisms, such as hooks, posts, straps, brackets, or the like. In some embodiments having a cavity, such as cavity 90, formed in footboard 34, one or more retention mechanisms (not shown), such as latches, retractable pins, clips, detents, straps, bands, arms, doors, or the like, are provided to retain module 34 in the cavity.

Figure 4:
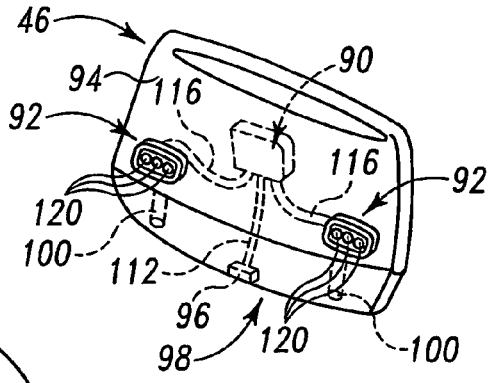
FIG. 4 is a perspective of the footboard of the compression therapy system of FIG. 1, showing a pair of conduit couplers accessible on a back wall of the footboard that faces toward a patient when the footboard is coupled to the hospital bed, a pair of conduits (in phantom) extending from the conduit couplers to the module-receiving cavity (in phantom), an electrical coupler (in phantom) situated at the bottom of the footboard, and an electrical line extending from the electrical coupler to the module-receiving cavity.

A pair of conduit couplers 92 are mounted or otherwise supported with respect to a back panel or wall 94 of footboard 46 as shown in FIG. 4. In addition, an electrical connector 96 is coupled to or otherwise supported with respect to a bottom 98 of footboard 46. When footboard 46 is coupled to deck 40, connector 96 mates with an associated electrical connector 99, shown in FIG. 1, that is coupled to deck 40. Illustratively, footboard 46 has a pair of sockets 100, shown in FIG. 4 (in phantom), and bed 32 has a pair of posts 110 that extend upwardly from deck 40 as shown in FIG. 1. Posts 110 are received in sockets 100 to couple footboard 46 to bed 32. As footboard 46 moves downwardly toward the foot end 50 of deck 40 during coupling of footboard 46 to bed 32, the upper ends of posts 110 enter sockets 100 to properly align connector 96 with connector 99 prior to the mating of connectors 96, 99.

Connector 99 is coupled via suitable electrical lines or conductors (not shown) to the electrical system of bed 32. Connector 96 is coupled via suitable electrical lines or conductors 112, shown in FIG. 4 (in phantom) to an electrical connector 114 that is accessible through cavity 90 as shown in FIG. 1. Thus, lines 112 which interconnect connectors 96, 114 are routed through an interior region which is defined between front panel 88 and back panel 94 of footboard 46. Conduit couplers 92 are coupled via respective pneumatic lines or conduits 116 to associated pneumatic couplers 118 which are accessible through cavity 90. Lines 116 which connect couplers 92 and respective couplers 118 are also routed through the interior region of footboard 46. In the illustrative embodiment, couplers 92 each have three ports 120 which mate with the ports 68, 80 of whichever of couplers 60, 76 are mated therewith. Couplers 60, 76 are selectively coupleable to either of couplers 92.

Module 34 has an electrical connector and a pair of pneumatic couplers that mate with connector 114 and couplers 118 when module 34 is received in cavity 90. In the illustrative embodiment, connector 114 and couplers 118 are associated with an upwardly facing surface that underlies cavity 90. In alternative embodiments, connector 114 and/or couplers 118 may be associated with any of the side surfaces, top surface, and/or back surface that cooperate with the upwardly facing surface to define cavity 90 in footboard 46. In these alternative embodiments, the associated electrical connector and pneumatic couplers of module 34 are located in the appropriate locations on module 34 so as to mate with the connector 114 and couplers 118 that are situated in the alternative locations on footboard 46.

Module 34 has a housing 122 with an interior region in which is situated electrical and pneumatic circuitry which operates to inflate and deflate sleeves 64, 78 in accordance with one or more control algorithms. User inputs 124 are provided on the front of housing 122 and are engaged by a user to input operating parameters into the circuitry of module 34. Such operating parameters may include inflation sequence, maximum/minimum inflation pressure(s), dwell time(s) after inflation, and the amount of time between inflations. One or more displays, such as an LED or a display screen, may be included in module 34 to communicate various data, such as operating conditions and alarm conditions, to the user. When module 34 is received in cavity 90, electrical power is provided through connectors 96, 99, 114 and lines 112 to module 34 from the electrical system of bed 32, which receives power either from a standard power outlet or from an on-board battery. In addition, data may be communicated between the circuitry of module 34 and the circuitry of bed 32 through connectors 96, 99, 114 and lines 112.

When module 34 is coupled to foot board 46 of bed 32 and when sleeve assemblies 36 are coupled to foot board 46 of bed 32, module 34 operates to inflate and deflate sleeves 52, 70 so as to apply compression therapy to one or more of the limbs of the patient resting on bed 32. Module 34 has its own battery that provides electrical power to operate the electrical and pneumatic circuitry thereof when module 34 is disconnected from foot board 46. However, because the circuitry of module 34 is provided with electrical power via bed 32 when module 34 is received in cavity 90 of foot board 46, the battery power of module 34 is conserved. In some embodiments, the battery of module 34 is recharged while module 34 is coupled to foot board 46.

Siderails 44 of bed 32 have various user inputs for controlling functions of bed 32. For example, the siderails 44 nearer the foot end of bed 32 have a set of caregiver control buttons 126 that are used by caregivers to articulate various sections of deck 40 and that are used by caregivers to raise, lower, and tilt deck 40 relative to a base 41 of bed 32. These same siderails 44 have a set of patient control buttons 127 that are accessible to the patient to articulate various sections of deck 40. The caregiver control buttons 126 may include buttons for locking out the patient control buttons 127 so that sections of deck 40 do not articulate in response to the patient pressing buttons 127. Illustratively, one of siderails 44 also has a display unit 128 with a display screen 130 and a set of buttons 131 that are used to scroll through and select various control options appearing on screen 130.

When module 34 is coupled to footboard 46 of bed 32, one or more of buttons 126, 131 may be used to enter operating parameters into module 34. In addition, data relating to operating parameters and alarm conditions may be displayed on screen 130, or otherwise retrieved, when module 34 is coupled to foot board. Thus, commands entered on buttons 126, 131 relating to the operation of module 34 are communicated to the circuitry of module 34 through the electrical control system of bed 32. Similarly, data sensed or otherwise generated by module 34 may be communicated through the electrical control system of bed 32 to display unit 128 for display on screen 130.

When the patient resting on bed 32 needs to exit bed 32, such as to go to the bathroom or to undergo physical therapy or other medical treatments or procedures, module 34 and couplers 60, 76 may be decoupled from foot board 46 and then couplers 60, 76 may be coupled directly to the pneumatic couplers of module 34 so that compression therapy can continue while the patient is away from bed 32. The battery of module 34 provides power to the circuitry of module 34 to inflate and deflate sleeves 52, 70 while the patient is out of bed 32. Illustratively, module 34 is small and lightweight and can be carried by the patient while the patient is ambulatory. Suitable belts, straps, harnesses, vests, or the like may be provided for the patient to carry module 34.

Figure 2:
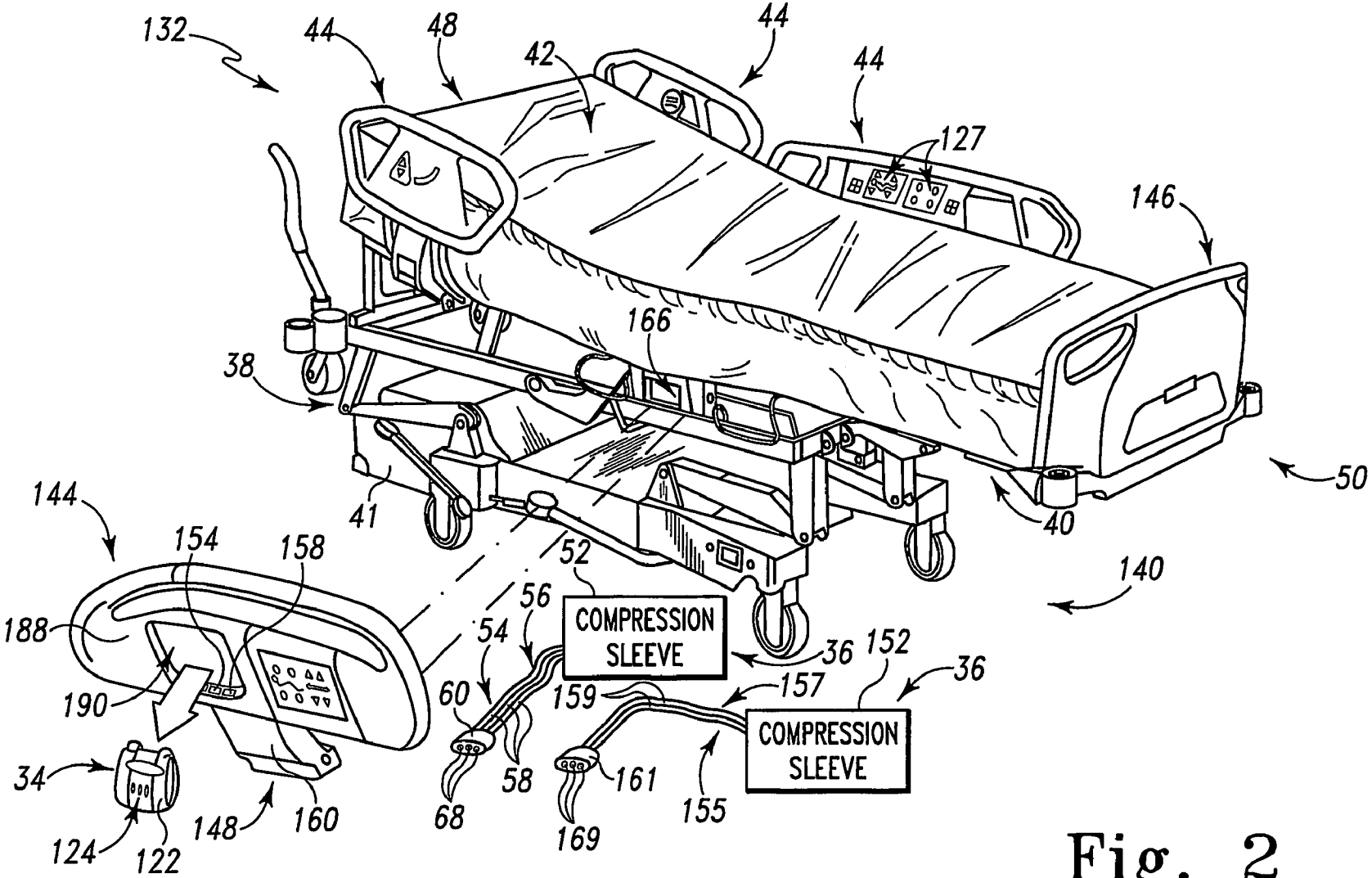
FIG. 2 is a perspective view of an alternative compression therapy system showing a hospital bed, a siderail exploded away from the a patient-support deck of the hospital bed, a compression module exploded away from a module-receiving cavity formed in the side rail, and a pair of diagrammatic compression sleeves exploded away from the siderail.

Referring now to FIG. 2, an alternative compression therapy system 140 comprises a bed 132 having a siderail 144 to which module 34 and sleeve assemblies 36 are each coupleable. Bed 132 is similar to bed 32 and therefore, like reference numerals are used to denote portions of bed 132 that are substantially the same as like portions of bed 32. Siderail 144 has a front panel or wall 188 that is formed to include a module-receiving cavity 190 in which compression module 34 is received when module 34 is coupled to siderail 144. Wall 188 may be formed, such as by molding, with cavity 190 therein or, alternatively, wall 188 may have a substantially planar portion with an opening and a separate piece or pieces that attach to the planar portion to define cavity 190 adjacent the opening.

In the illustrative embodiment, cavity 190 is sized to receive the entire module 34 therein. In alternative embodiments, a smaller cavity is provided in siderail 144 and only a portion of module 34 is received in this alternative cavity. In still further embodiments, no cavity is provided in siderail 144 and module 34 couples to siderail 144 via other mechanisms, such as hooks, posts, straps, brackets, or the like. As was the case with cavity 90 of foot board 46 of bed 32, one or more retention mechanisms (not shown), such as latches, retractable pins, clips, detents, straps, bands, arms, doors, or the like, may be provided to retain module 34 in cavity 190 of siderail 144 of bed 132. Bed 132 has a foot board 146 without any module-receiving cavity formed therein. In alternative embodiments, each of the footboard and one or more siderails of a bed may have module-receiving cavities provided therein for receiving module 34.

Figure 5:
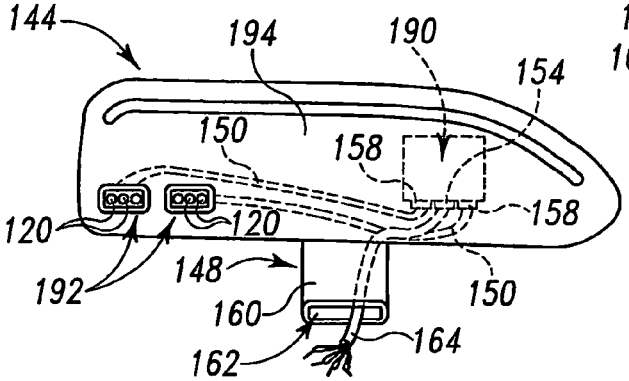
FIG. 5 is a side elevation view of the siderail of the compression therapy system of FIG. 2, showing a pair of conduit couplers accessible on a side wall of the siderail that faces toward a patient, a pair of conduits (in phantom) extending from the conduit couplers to the module-receiving cavity (in phantom), and an electrical line extending from the module-receiving cavity out of the siderail.

A pair of conduit couplers 192 is mounted or otherwise supported with respect to a back panel or wall 194 of siderail 144 as shown in FIG. 5. Couplers 192 have ports 120 as was the case with couplers 92 associated with footboard 46. Either of compression sleeve assemblies 36 are coupleable to either of couplers 192 associated with siderail 144. Compression sleeve assembly 36 having sleeve 52 is shown diagrammatically in FIG. 2. An alternative compression sleeve assembly 36 having a sleeve 152 is also shown diagrammatically in FIG. 2. Associated with sleeve 152 are conduits 155 forming a ribbon 157 having two tubes 159 which extend from sleeve 152 to a conduit coupler 161 having ports 169. The two tubes 159 suggests that sleeve 152 has two inflatable sections. Of course, sleeves having any number of inflatable sections are contemplated by this disclosure. Coupler 161 is also coupleable to couplers 192 of siderail 144 and to couplers 92 of foot board 46 of bed 32. Two of ports 169 of coupler 161 are in pneumatic communication with respective tubes 159 and one of ports 169 is a "dummy" port.

An electrical connector 154 and a pair of pneumatic couplers 158 are accessible in cavity 190 of siderail 144 as shown in FIGS. 2 and 5. Couplers 158 are coupled to respective couplers 192 by respective pneumatic lines 150 that are routed through an interior region of siderail 144 which is defined between walls 188, 194 of siderail 144. A mechanism 148 is provided for pivotably coupling siderail 144 to deck 40 of bed 132 so that siderail 144 is movable between a raised, use position and a lowered, storage position. Mechanism 148 comprises an arm 160 having an interior region 162 as shown in FIG. 5. An electrical line 164 extends from connector 154 and is routed to the electrical control system of bed 132 through interior region 162 of arm 160 and through an opening 166 formed in deck 40.

Module 34 has an electrical connector and a pair of pneumatic couplers as mentioned above. The electrical connector and pneumatic couplers of module 34 mate with connector 154 and couplers 158, respectively, when module 34 is received in cavity 190 of siderail 144. In the illustrative embodiment, connector 154 and couplers 158 are associated with an upwardly facing surface of siderail 144 that underlies cavity 190. In alternative embodiments, connector 154 and/or couplers 158 may be associated with any of the side surfaces, top surface, and/or back surface that cooperate with the upwardly facing surface to define cavity 190 in siderail 144. In these alternative embodiments, the associated electrical connector and pneumatic couplers of module 34 are located in the appropriate locations on module 34 so as to mate with the connector 154 and couplers 158 that are situated in the alternative locations on siderail 144.

When module 34 is received in cavity 190, electrical power is provided through connector 154 and line 164 to module 34 from the electrical system of bed 32, which receives power either from a standard power outlet or from an on-board battery. In addition, data may be communicated between the circuitry of module 34 and the circuitry of bed 32 through connector 154 and line 164. Any one or more of siderails 44, 144 of bed 132 may have various user inputs for controlling functions of bed 32. For example, any of siderails 44, 144 of bed 132 may have caregiver control buttons 126 and/or patient control buttons 127 similar to those of bed 32. In addition, any one or more of siderails 44, 144 of bed 132 may have a display unit (not shown) with associated screen and user inputs similar to display unit 128 of bed 32. When module 34 is coupled to siderail 144 of bed 132, one or more of buttons 126 and/or the user inputs of any associated display unit may be used to enter operating parameters into module 34. In addition, data relating to operating parameters and alarm conditions may be displayed on the screen of any associated display unit, or otherwise retrieved, when module 34 is coupled to siderail 144. Such commands and data may be communicated through the electrical control system of bed 132 as was the case with bed 32.

When module 34 is coupled to siderail 144 of bed 132 and when sleeve assemblies 36 are coupled to siderail 144 of bed 132, module 34 operates to inflate and deflate sleeves 52, 70, 152, as the case may be, so as to apply compression therapy to one or more of the limbs of the patient resting on bed 132. The battery of module 34 may be recharged while module 34 is coupled to siderail 144. When the patient resting on bed 32 needs to exit bed 32, module 34 and couplers 60, 76, 161, as the case may be, are decoupled from siderail 144 and then couplers 60, 76, 161, as the case may be, are coupled directly to the pneumatic couplers of module 34 so that compression therapy can continue while the patient is away from bed 32. The battery of module 34 provides power to the circuitry of module 34 to inflate and deflate sleeves 52, 70, 152, as the case may be, while the patient is out of bed 32.

Figure 3:
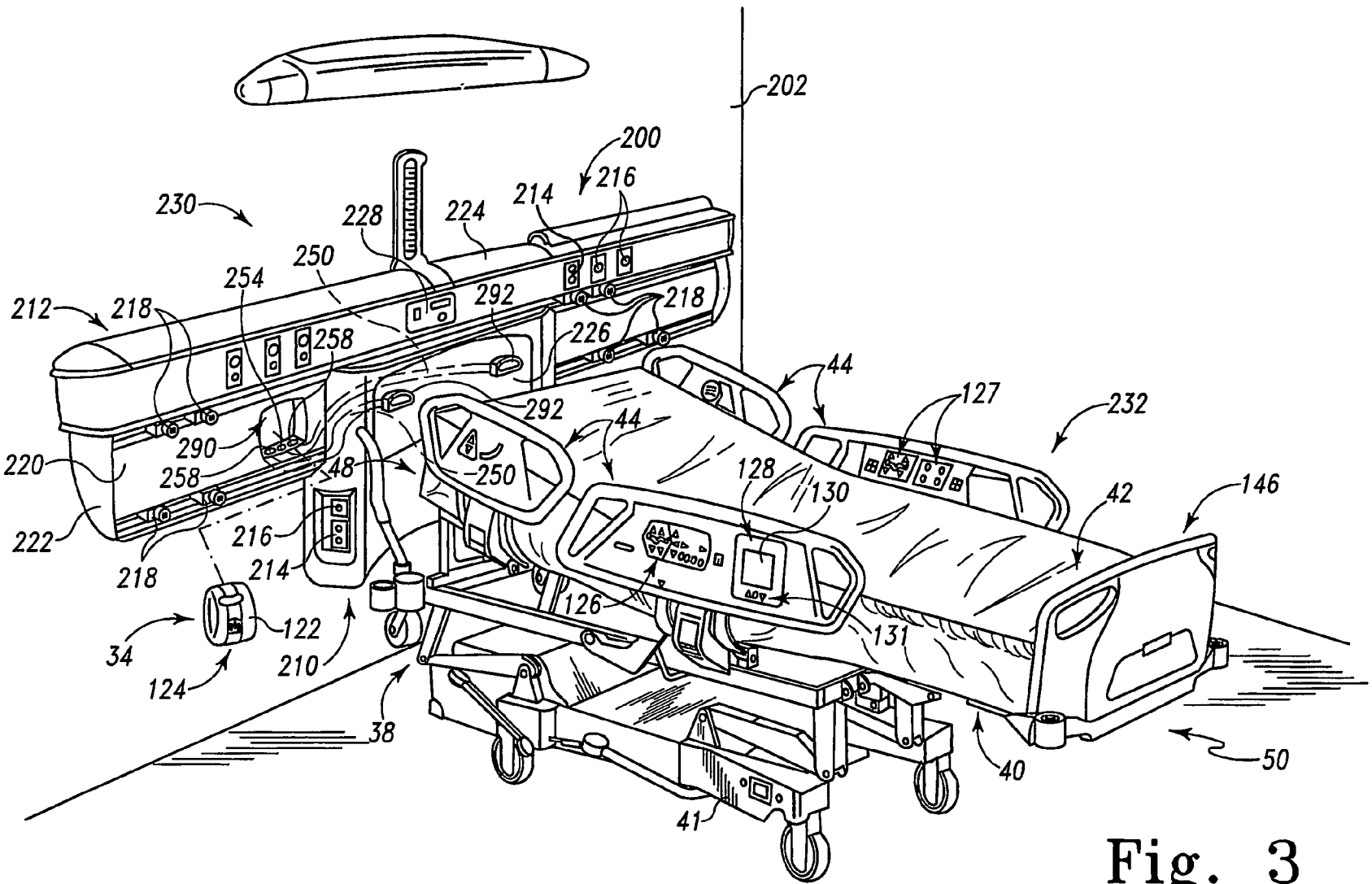
FIG. 3 is a perspective view of another alternative compression therapy system showing a hospital bed situated near a headwall unit, a compression module exploded away from the headwall unit, the compression module being configured for insertion into a module-receiving cavity of the headwall unit, and a pair of conduits (in phantom) being routed through the headwall unit from the module-receiving cavity to respective conduit couplers that are accessible on a portion of the headwall unit adjacent an end of the hospital bed.

Referring now to FIG. 3, an alternative compression therapy system 230 comprises a headwall unit 200 that is coupled to a wall 202 of a healthcare facility and that has a cavity 290 which is configured for receiving module 34. Illustrative headwall unit 200 has a bed locator portion 210 and a main portion 212 coupled to portion 210. Beds, stretchers, or other patient support devices, such as an illustrative bed 232 may be positioned adjacent portion 210 of headwall unit 200 as shown in FIG. 3. Bed 232 is similar to beds 32, 132 and therefore, like reference numerals are used to denote portion of bed 232 that are substantially similar to like portions of beds 32, 132.

Headwall unit 200 has a plurality of electrical power outlets 214 from which electrical power is available, a plurality of data ports or outlets 216 which are coupled to a computer network of the healthcare facility, and a plurality of gas service outlets 218 which are coupled to a medical gas system of the healthcare facility. Illustrative headwall unit 200 also has an intercom or nurse call module 228 which is configured for communication with other such modules in other rooms and with a master nurse station of the healthcare facility. Various types of medical gas services, such as oxygen, nitrogen, carbon dioxide, nitrous oxide, medical air, and medical suction are available via respective ones of outlets 218. Thus, medical equipment (not shown) may plug into outlets 214 to receive power, may couple to one or more of outlets 218 to receive gas or suction, and may couple to ports 216 to communicate with other computer devices of the computer network of the healthcare facility.

Portion 212 of headwall unit 200 has a front panel or wall 220 in which the module-receiving cavity 290 is provided. For example, wall 220 may be formed, such as by molding, with cavity 290 therein or, alternatively, wall 220 may have a substantially planar portion with an opening and a separate piece or pieces that attach to the planar portion to define cavity 290 adjacent the opening. In alternative embodiments, cavity 290 may be provided in a side wall 222 or a top wall 224 or any other portion of headwall unit 200. In the illustrative embodiment, cavity 290 is sized to receive the entire module 34 therein. In alternative embodiments, a smaller cavity is provided in unit 200 and only a portion of module 34 is received in this alternative cavity. In still further embodiments, no cavity is provided in unit 200 and module 34 couples to unit 200 via other mechanisms, such as hooks, posts, straps, brackets, or the like. As was the case with cavity 90 of foot board 46 of bed 32 and with cavity 190 of siderail 144 of bed 132, one or more retention mechanisms (not shown), such as latches, retractable pins, clips, detents, straps, bands, arms, doors, or the like, may be provided to retain module 34 in cavity 290 of unit 200.

A pair of conduit couplers 292 is mounted or otherwise supported with respect to a front panel or wall 226 of bed locator portion 210 of unit 200 as shown in FIG. 3. Couplers 292 have ports (not shown) that are substantially similar to ports 120 of couplers 92, 192 associated with footboard 46 and siderail 144, respectively. Each of the above-described compression sleeve assemblies 36 is coupleable to either of couplers 292 associated with unit 200. In some embodiments, such as the illustrative embodiment having head end 48 of bed 232 adjacent headwall unit 200, conduit extenders are provided to interconnect couplers 292 with couplers 60, 76, 161, as the case may be, of sleeve assemblies 36. If bed 232 is positioned with foot end 50 adjacent headwall unit 200, then the conduit extenders may not be needed.

An electrical connector 254 and a pair of pneumatic couplers 258 are accessible in cavity 290 of headwall unit 200 as shown in FIG. 3. Couplers 258 are coupled to respective couplers 292 by respective pneumatic lines 250 that are routed through an interior region of unit 200. The interior region of illustrative unit 200 is defined behind walls 220, 226 and beneath wall 224. An electrical line (not shown) extends from connector 254 and couples to power lines and/or computer network lines of the healthcare facility. The electrical connector and pneumatic couplers of module 34 mate with connector 254 and couplers 258, respectively, when module 34 is received in cavity 290 of unit 200. In the illustrative embodiment, connector 254 and couplers 258 are associated with an upwardly facing surface of portion 212 that underlies cavity 290. In alternative embodiments, connector 254 and/or couplers 258 may be associated with any of the side surfaces, top surface, and/or back surface that cooperate with the upwardly facing surface to define cavity 290 in portion 212 of unit 200. In these alternative embodiments, the associated electrical connector and pneumatic couplers of module 34 are located in the appropriate locations on module 34 so as to mate with the connector 254 and couplers 258 that are situated in the alternative locations within cavity 290.

When module 34 is received in cavity 290, electrical power is provided to module 34 through connector 254 and the associated power lines of the healthcare facility. In addition, data may be communicated between the circuitry of module 34 and the computer network of the healthcare facility through connector 254 and associated data lines. If the electrical control system of bed 232 is coupled to the computer network of the healthcare facility, then one or more of the user inputs 126, 131 of bed 232 may be used to enter operating parameters into module 34, which operating parameters are communicated to module 34 from bed 232 through the computer network of the healthcare facility. In addition, data relating to operating parameters and alarm conditions of module 34 may be communicated to bed 232 through the computer network of the healthcare facility to be displayed on the screen 130 of display unit 128. Alternatively, a display unit similar to unit 128 and/or a module, similar to module 228, may be provided on headwall unit 200 (or elsewhere) and may be used to communicate operating parameters to module 34 and/or to receive for display data relating to the operating parameters or alarm conditions of module 34.

When module 34 is received in cavity 290 of headwall unit 200 and when sleeve assemblies 36 are coupled to couplers 292 of headwall unit 200, module 34 may be operated to inflate and deflate the sleeves of sleeve assemblies 36 so as to apply compression therapy to one or more of the limbs of the patient to which the sleeves are coupled while the patient is resting in bed 232. The battery of module 34 may be recharged while module 34 is coupled to headwall unit 200. When the patient resting on bed 232 needs to exit bed 232, module 34 and sleeve assemblies 36 are decoupled from unit 200 and then sleeve assemblies 36 are coupled directly to the pneumatic couplers of module 34 so that compression therapy can continue while the patient is away from bed 232. The battery of module 34 provides power to the circuitry of module 34 to inflate and deflate the sleeves of sleeve assemblies 36 while the patient is out of bed 232.

In alternative embodiments, pressurized gas from a separate or external gas source of the medical gas system of the healthcare facility may be used to inflate the sleeves of sleeve assemblies 36 when sleeve assemblies are coupled to couplers 292 associated with unit 200. In such alternative embodiments, module 34 may have an additional pneumatic coupler that mates with an associated pneumatic coupler in cavity 290 to receive the pressurized gas from the separate gas source when module 34 is received in cavity 290. Also in such embodiments, the pneumatic circuitry and electrical circuitry of module 34 is operable to control the flow of pressurized gas from the external gas source to the sleeve assemblies 36. By using pressurized gas from the external gas source when module 34 is received in cavity 290, the usage of the internal or on-board pressure generator (i.e., pump or compressor) of module 34 is conserved thereby prolonging the useful life of the pressure generator of module 34.

Figure 6:
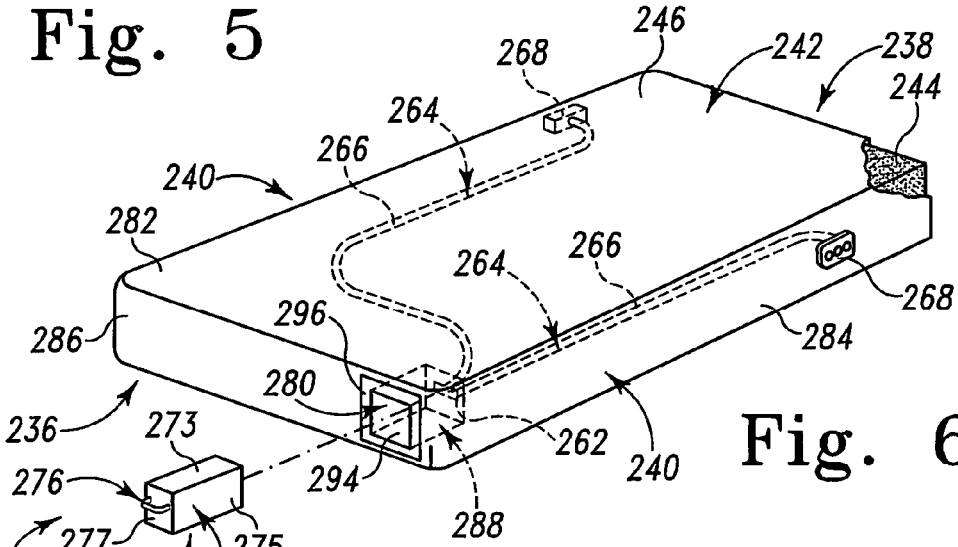
FIG. 6 is a perspective view of a further alternative compression therapy system showing a mattress having a module-receiving cavity at a head end thereof, a compression module configured for insertion into the module-receiving cavity, a pair of conduit couplers accessible on opposite sides of the mattress near a foot end of the mattress, and a pair of conduits (in phantom) extending from the module-receiving cavity to respective conduit couplers.
Figure 7:
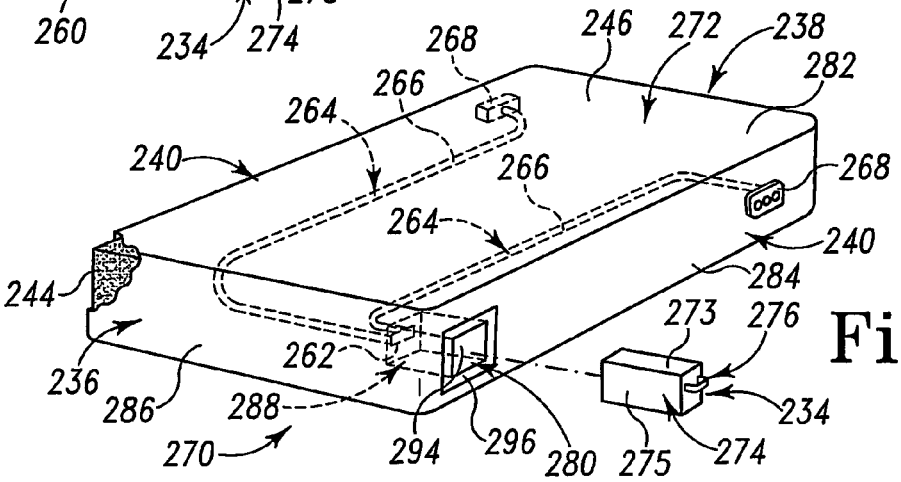
FIG. 7 is a perspective view of another alternative compression therapy system, similar to the system of FIG. 6, but having a module-receiving cavity in one of the sides near the head of the mattress.
Figure 8:
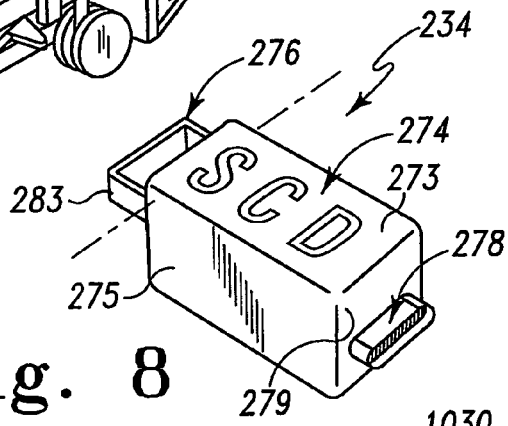
FIG. 8 is a perspective view of an alternative compression module showing the module having a substantially rectangular, box-shaped housing, a conduit coupler at one end of the housing, and a handle at an opposite end of the housing.

An alternative compression module 234, shown in FIG. 8, may be used either with a first patient support apparatus or mattress 242, shown in FIG. 6, to form a compression therapy system 260, or with a second patient support apparatus or mattress 272, shown in FIG. 7, to form a compression therapy system 270. Mattresses 242, 272 may be used on any of beds 32, 132, 232 in lieu of mattress 42 or may be used on any other type of person support device, such as a stretcher, surgical table, cot, bedframe, etc. Mattresses 242, 272 each have a head end 236, a foot end 238 spaced longitudinally from head end 236, and a pair of sides 240 extending longitudinally between ends 236, 238.

Each mattress 242, 272 comprises a core 244 and a coverlet 246 having an interior region in which core 244 is situated. Each mattress 242, 272 also has a module-receiving cavity 280 formed in core 244. Illustrative module 234 is shaped like an elongated box and cavities 280 of mattresses 242, 272 are similarly shaped. In system 260, the long dimension of cavity 280 of mattress 242 is parallel with long dimension of mattress 242. In system 270, the long dimension of cavity 280 of mattress 272 is orthogonal to the long dimension of mattress 272. Illustrative cavities 280 are situated adjacent head end 236 of mattresses 242, 272 near one of the head end corners thereof to minimize the chance that a person resting on mattress 242 or mattress 272 feels module 234 through core 244. However, it is within the scope of this disclosure for cavities 280 to be situated anywhere in mattresses 242, 272.

Core 244 comprises one or more support elements, such as foam elements, air bladders, gel layers, springs, and the like. All types of support elements used in mattresses are contemplated by this disclosure. Coverlet 246 comprises a top sheet or panel 282, a bottom sheet or panel (not shown), a pair of side sheets or panels 284, and a pair of end sheets or panels 286 as shown in FIGS. 6 and 7. Panels 282, 284, 286, and the bottom panel of coverlet 246 may be fastened together, such as by sewing, adhesive, or RF welding, for example, to form a one-piece coverlet. In such embodiments an opening may be provided somewhere on coverlet 246, perhaps on panel 286 at the foot end 238 of mattresses 242, 272, through which core 244 may be accessed. Closure members, such as zippers, snaps, or one or more flaps with hook and loop fastener elements may be provided on coverlet 246 for opening and closing such an opening. In alternative embodiments, coverlet 246 may be a multi-piece coverlet having separate sections that are coupleable together with couplers, such as zippers, snaps, or hook and loop fastener elements.

Coverlet 246 of each mattress 242, 272 has an opening through which cavity 280 of the associated core 244 is accessed. Specifically, this opening is provided in the head end panel 286 of coverlet 246 of mattress 242 and is provided in one of the side panels 284 of coverlet 246 of mattress 272. Each mattress 242, 272 has a liner member 288 that lines the associated cavity 280 and that has a space shaped to module 234. Liner member 288 is made of a fairly rigid material, such as metal or plastic, to prevent cavities 280 of mattresses 242, 272 from deforming or collapsing when a person is resting on respective mattresses 242, 272. Thus, liner member 288 ensures that module 234 is insertable into and removable from cavity 280 regardless of whether or not a person is resting on either of mattresses 242, 272. Illustratively, portions of core 244 surround the top, bottom, sides, and one of the ends of liner member 288.

Liner member 288 of each mattress 242, 272 has a box-like, first portion 294 that lines the respective cavity 280 and a second portion 296 that couples to the associated coverlet 246 as shown in FIGS. 6 and 7. Illustratively, second portion 296 comprises a flange (sometimes referred to herein as "flange 296") that couples to coverlet 246 adjacent the opening in coverlet 246 through which cavity 280 is accessed. Flange 296 is square-shaped and extends perpendicularly outwardly from the top, bottom, and side walls of portion 294. Thus, portions of coverlet 246 are situated between flange 296 and core 244. Flange 296 may be coupled to coverlet 246 by any suitable fastener, such as adhesive, snaps, RF welding, clips, tabs, or the like. In some embodiments, mattresses 242, 272 have liner members 288 that are removable from the associated cavities 280 and that can be replaced with one or more filler elements (not shown), such as a foam element, an air bladder, etc., that fills cavities 280 when the patient resting on either of mattresses 242, 272 does not need compression therapy.

A coupler 262 having a set of pneumatic ports is formed in or is otherwise coupled to the end wall of portion 294 of liner member 288 in the interior region of core 244 of each of mattresses 242, 272. Each mattress 242, 272 comprises a pair of conduits 264, which, in turn, each has one or more tubes 266 and a conduit coupler 268 having a set of pneumatic ports. Tubes 266 are routed through the interior region of coverlet 246 between coupler 262 and respective couplers 268 which are situated outside the interior region of coverlet 246. Illustratively, couplers 262 are coupled to side panels 284 of coverlet 246 closer to the foot end 238 of respective mattresses 242, 272 than to the head end 236 thereof. In alternative embodiments, couplers 262 are coupled to other portions of coverlet 246 or are detached from coverlet altogether and are coupled only to ends of tubes 266 outside of the interior region of coverlet 246.

Tubes 266 may be routed between various elements that comprise cores 244 of mattresses 242, 272, through tunnels or channels or other passageways formed in the various elements that comprise cores 244 of mattresses 242, 272, and/or between cores 244 and portions of the associated coverlets 246. In some embodiments, tubes 266 may have support members, such as metal coils, rigid collars, or rigid sheaths, that are embedded therein, formed thereon, or otherwise associated therewith. These support members may serve to inhibit tubes 266 from kinking or collapsing due to the weight of a person resting on mattresses 242, 272 or due to articulation of mattresses 242, 272 along with the underlying bedframe.

Module 234 has a main housing 274, a handle 276 coupled to one end of housing 274, and a pneumatic coupler 278 extending from an opposite end of housing 274 as shown in FIG. 8. Illustrative housing 274 is box-shaped having a rectangular top wall 273, a pair of rectangular side walls 275, a first end wall 277 that is substantially square-shaped, a second end wall 279 that is substantially square-shaped, and a rectangular bottom wall (not shown) that is substantially similar to top wall 273. It is within the scope of this disclosure, however, for module 234 to have any suitable shape for receipt in correspondingly shaped cavities of mattresses 242, 272. Pneumatic coupler 278 has a set of pneumatic ports and, illustratively, is oval in shape. Coupler 278 may have any shape so long as coupler 262 is correspondingly shaped to permit couplers 278, 262 to mate together.

In the illustrative embodiment, handle 276 is pivotable about an axis 281 relative to housing 274 between a use position, shown in FIG. 8, and a storage position (not shown). In some embodiments, wall 277 of housing 274 has a recess (not shown) that receives handle 276 when handle 276 is pivoted to the storage position so that an edge 283 of handle 281 is substantially coplanar with the main portion of wall 277. Optionally, a spring or other biasing member may be provided for biasing handle 276 toward the storage position. Module 234 is sized so that, when inserted fully into cavity 280 of either mattress 242, 272, coupler 278 mates automatically with coupler 262. In some embodiments, wall 279 of housing may abut the back wall of liner member 288 and wall 277 may be substantially coplanar with flange 296 when module 234 is inserted fully into cavity 280.

One or more retention mechanisms (not shown), such as latches, retractable pins, clips, detents, straps, bands, arms, doors, or the like, may be provided to retain module 234 in cavity 280 of respective mattresses 242, 272. In some embodiments, a retractable lock member, such as a pin or a lug, extends from housing 274 into an aperture formed in each liner member 288 to lock module 234 in the respective cavity 280 of mattresses 242, 272. In such embodiments, movement of handle 276 about axis 281 from the storage position to the use position may be transferred via a suitable mechanism, such as a cable or other type of linkage, to retract the lock member from the aperture of liner member 288 thereby unlocking module 234 for removal from the respective cavity 280. A spring or other type of biasing element may be provided to bias the lock member to its extended position relative to housing 274.

Housing 274 carries electrical circuitry, including a power source, and pneumatic circuitry, including a pressure generator. Thus, when module 234 is received in cavity 280 of either mattress 242, 272 and when sleeve assemblies 36 are coupled to couplers 262 of the associated mattress 242, 272, module 234 may be operated to inflate and deflate the sleeves of sleeve assemblies 36 so as to apply compression therapy to one or more of the limbs of the patient to which the sleeves are coupled while the patient is resting on the associated mattress 242, 272. In some embodiments, user inputs and/or a display may be provided on wall 277 of module 234 to allow a user to enter operating parameters into module 234 and/or to view operating or alarm data. In other embodiments, module 234 is pre-programmed with a permanent set of operating parameters.

Figure 9:
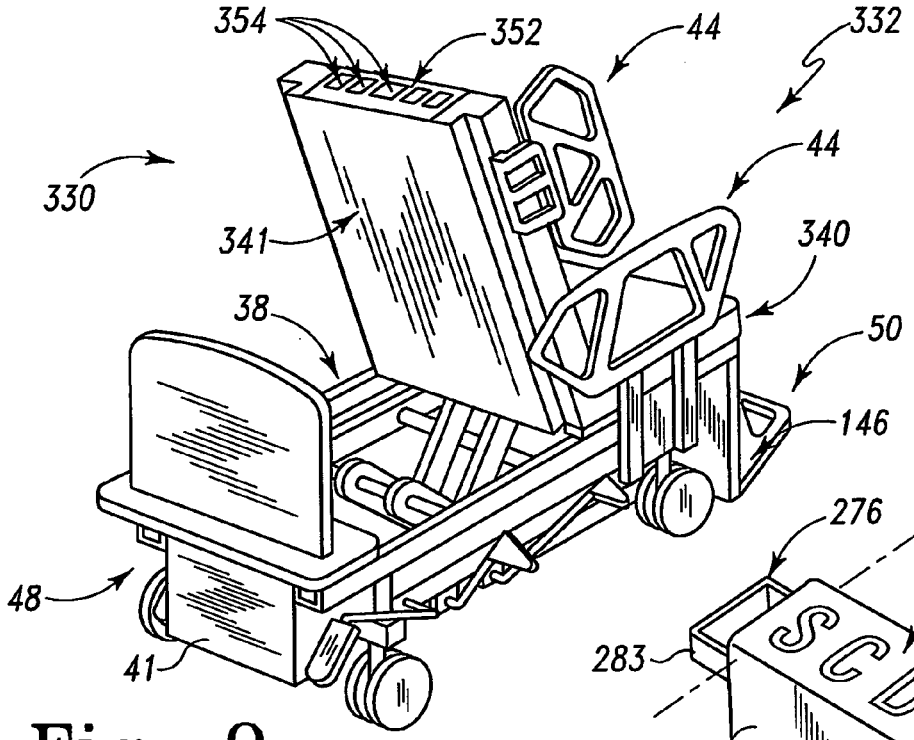
FIG. 9 is a perspective view of an alternative hospital bed having a patient-support deck with a pivotable head deck section that includes a module-receiving cavity configured to receive therein the compression module of FIG. 8.
Figure 10:
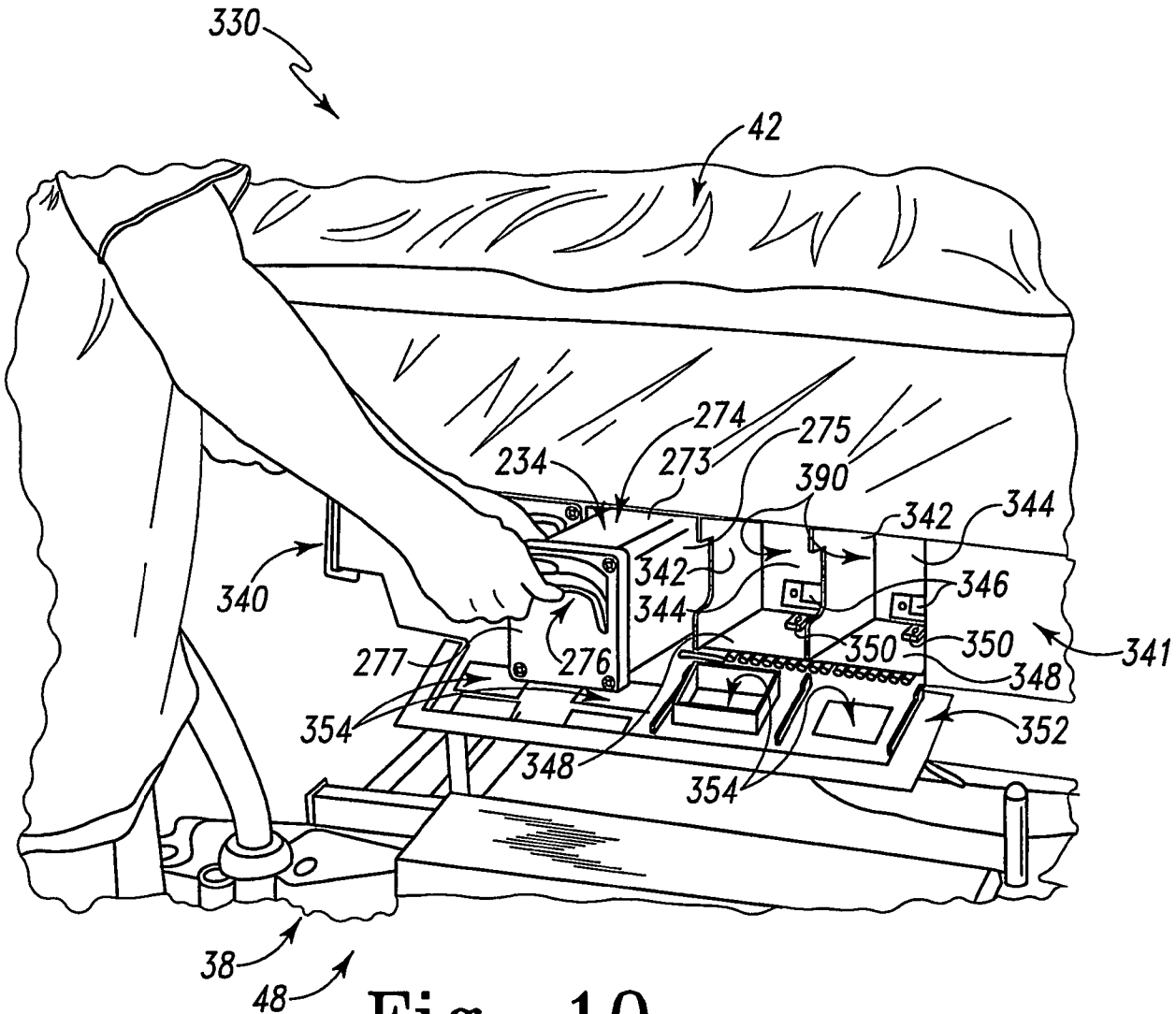
FIG. 10 is a fragmentary perspective view showing a caregiver inserting the compression module of FIG. 8 part way into the module-receiving cavity included in the head deck section of the hospital bed of FIG. 9.

Referring now to FIGS. 9 and 10, an alternative hospital bed 332 with which module 234 may be used to form yet another compression therapy system 330 according to this disclosure, has a patient-support deck 340 with a pivotable deck section 341. Illustratively, deck section 341 supports a head portion of mattress 42. Bed 332 is similar to bed 32 and bed 132 and therefore, like reference numerals are used to denote portions of bed 332 that are substantially the same as like portions of bed 32 and bed 132. Deck 340 of bed 332 is movable into a chair configuration as shown in FIG. 9.

Deck section 341 has a plurality of module-receiving cavities 390 at least one of which is configured to receive compression module 234 as shown in FIG. 10. A set of partition walls or plates 342 are provided between adjacent cavities 390. Other types of modules, such as those shown and described in U.S. Pat. Nos. 6,119,291; 6,047,424; and 5,630,238; which are hereby incorporated by reference herein, may be inserted into associated cavities 290 to perform other therapies or functions, such as percussion and vibration therapy, rotation therapy, inflation of a low airloss mattress, fluidization of a mattress having fluidizable media, etc.

Section 341 of deck 340 has a set of back walls 344 which have pneumatic and/or electrical couplers 346 mounted thereto or otherwise associated therewith as shown in FIG. 10. When module 234 is inserted fully into the associated cavity 390 of deck 340, coupler 278 of module 234 mates automatically with the respective coupler 346. In addition, wall 279 of module 234 may abut the associated wall 344 of deck 340 when module 234 is inserted fully into the respective cavity 390. In the illustrative embodiment, section 341 of deck 340 has a set of bottom walls 348 which have lock-receiving bosses 350 formed therein. Alternatively, separate lock-receiving bosses may be coupled to or otherwise supported with respect to bottom walls 348.

Bosses 350 have apertures or pockets that receive lock members which extend from the modules, such as module 234, that are inserted into the associated cavities 390. Receipt of the lock members in the apertures or pockets of bosses 350 retains the modules in cavities 390. As mentioned above, module 234 may have a suitable mechanism to move the associated lock member from the extended position to a retracted position in response to movement of handle 276 from the storage position to the use position. In alternative embodiments, module 234 may have an aperture or pocket and deck may have a lock member that retains module 234 in the associated cavity 390. In the illustrative embodiment, a door 352 is provided to further retain the modules, such as module 234, in the associated cavities 390. Door 352 is a unitary structure that moves to block or allow access simultaneously to all of cavities 390 and the modules therein. In some alternative embodiments, door 352 is omitted. In still other alternative embodiments, a set of smaller doors are provided and are associated with individual cavities 390. A set of windows 354 are provided in door 352 for viewing portions of the modules received in cavities 390. Door 352 is hinged to section 341 of deck 340 along the bottom edge and a suitable biasing member, such as a torsion spring, is provided to bias door 352 from the opened position, shown in FIG. 10, toward the closed position, shown in FIG. 9.

Bed 332 has a set of conduits (not shown) that are routed from the coupler 346 associated with module 234 to one or more other couplers located elsewhere on bed 332. Such other couplers may be located anywhere on bed 332, such as on the footboard 146, siderails 44, other sections of deck 340, frame 38, base 41, and/or mattress 42. Sleeve assemblies 36 are coupleable to these couplers and module 234 is operable to inflate and deflate the sleeves of sleeve assemblies to apply compression therapy to the patient to which the sleeves are coupled. In some embodiments, module 234 receives power from and/or communicates with the electrical system of bed 332 and can be programmed with the user controls of bed 332 as described above in connection with beds 32, 132.

Figure 11:
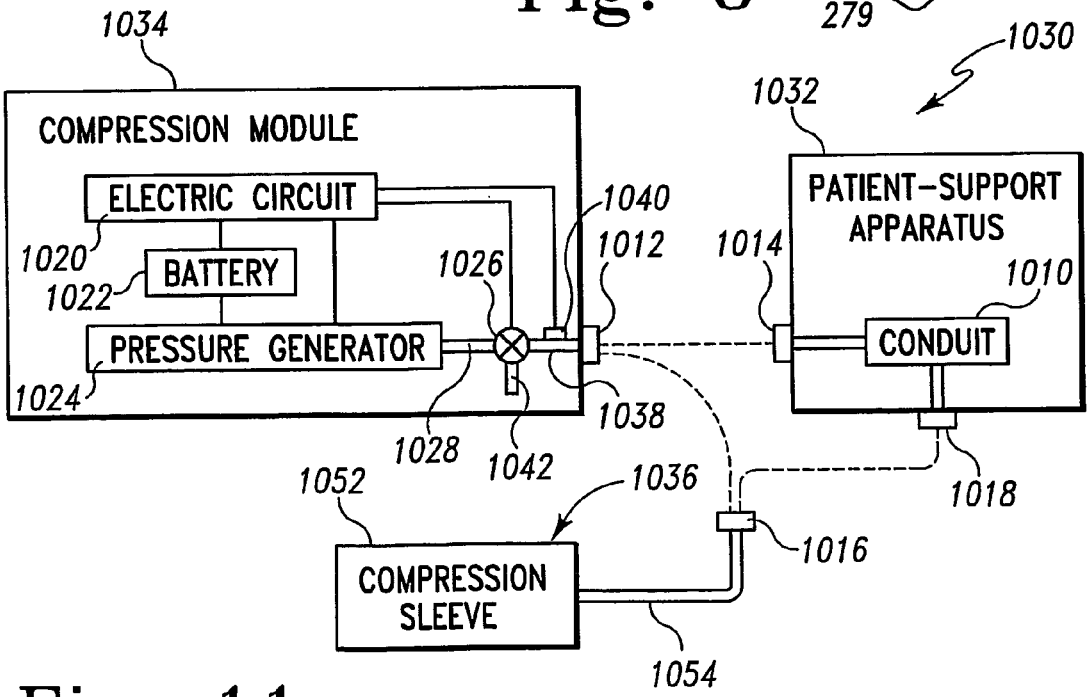
FIG. 11 is a block diagram showing a bed having a conduit routed therethrough, a compression module that is coupleable to the bed, and a compression sleeve that is selectively coupleable to the bed and to the compression module.

In accordance with this disclosure, therefore, a compression therapy system 1030 comprises a compression module 1034 which is coupleable to a conduit 1010 that is routed through a portion of a patient-support apparatus 1032 and is also coupleable to a conduit 1054 of a compression sleeve assembly 1036 as shown diagrammatically in FIG. 11. Assembly 1036 is selectively coupleable to patient-support apparatus 1032 and to module 1036. Module 1034 has a pneumatic coupler 1012 with one or more outlet ports that mate with associated inlet ports of a first pneumatic coupler 1014 of patient-support apparatus 1032. Assembly 1036 has a pneumatic coupler 1016 with one or more inlet ports that mate with associated outlet ports of a second pneumatic coupler 1018 of apparatus 1032. Apparatus 1032 may be a bed, a stretcher, a surgical table, a chair, or the like, or a portion thereof, such as a mattress or a support pad.

Module 1034 has an electric circuit 1020, a battery 1022, and a pressure generator 1024 as shown diagrammatically in FIG. 11. Pressure generator 1024 may comprise, for example, a pump, a compressor, a blower, or any other device capable of inflating a compression sleeve. Battery 1022 supplies power via suitable electrical conductors to circuit 1020 and to pressure generator 1024. The term "battery" as used herein is intended to cover all types of electrical power storage devices including, for example, a single battery cell, a plurality of battery cells, a battery pack, and one or more capacitors.

Module 1034 also has one or more valves 1026 which, in some embodiments, are coupled to a manifold. Module 1034 has one or more conduits 1028 extending between pressure generator and 1024 either valve(s) 1026 or the manifold to which valve(s) 1026 are coupled. In addition, module 1034 has one or more conduits 1038 that extend between the port(s) of coupler 1012 and either valve(s) 1026 or the manifold to which valve(s) 1026 are coupled. Illustratively, one or more pressure sensors 1040 of module 1034 are exposed to the pressure in conduit(s) 1038 and are coupled via suitable electrical conductors to circuit 1020. One or more vent conduits 1042 are coupled either to valve(s) 1026 or to the manifold to which valve(s) 1026 are coupled.

When module 1034 is detached from apparatus 1032 and coupler 1016 of sleeve assembly 1036 is coupled to coupler 1012 of module 1034, circuit 1020 sends control signals to pressure generator 1024 and to valve 1026 to control the inflation and deflation of a compression sleeve 1052 which is coupled to a person's limb. For example, during an inflation cycle, circuit 1020 signals valve 1026 to move to an inflation position having conduit 1028 in fluid communication with conduit 1038, which is in fluid communication with conduit 1054 through couplers 1012, 1016. Valve 1026 is configured so that, when valve 1026 is in the inflation position, conduit 1042 is blocked from fluid communication with conduits 1028, 1038.

After valve 1026 moves to the inflation position, circuit 1020 activates pressure generator 1024 to inflate sleeve 1052 through valve 1026, conduits 1028, 1038, 1054, and couplers 1012, 1016. Sensor 1040 provides feedback to circuit 1020 which is indicative of the pressure in conduit 1038 which, in turn, correlates to the pressure in sleeve 1052. When the pressure in sleeve 1052 reaches a desired pressure value corresponding to maximum inflation pressure, circuit 1020 deactivates pressure generator 1024 and moves valve 1026 either to an inflation-hold position or a deflation position, depending upon the control algorithm programmed into circuit 1020. In the inflation-hold position, the pneumatic communication between conduit 1038 and conduits 1028, 1042 is blocked by valve 1026. Thus, sleeve 1052 remains inflated when valve 1026 is moved to the inflation-hold position after inflation of sleeve 1052. In those embodiments having an inflation-hold cycle after the inflation cycle, valve 1026 moves to the deflation position after a programmed period of time. In the deflation position, conduit 1038 is in fluid communication with conduit 1042 which, in turn, is in fluid communication with the ambient environment. Thus, the pressurized fluid in sleeve 1052 vents to the ambient environment through conduits 1038, 1042, 1054 and couplers 1012, 1016 when valve 1026 is in the deflation position.

Although illustrative module 1034 is shown in FIG. 11 as having only one valve 1026, a plurality of valves 1026 may be included in module 1034 as mentioned above. In such embodiments having plural valves 1026, conduit 1028 may communicate with each of the plurality of valves 1026 through passages of an associated manifold. Also in such embodiments having plural valves 1026, a plurality of conduits 1038 may be provided for inflating an associated plurality of sections or bladders of an alternative compression sleeve assembly. Circuit 1020 may be programmed to operate the plurality of valves and to activate/deactivate pressure generator 1024 according to any desired control algorithm, including a sequential inflation algorithm in which blood flow is promoted in a direction toward a person's torso.

When module 1034 is coupled to apparatus 1032 such that coupler 1012 is coupled to coupler 1014 and when sleeve assembly 1036 is coupled to apparatus 1032 such that coupler 1016 is coupled to coupler 1018, circuit 1020 signals valve 1026 and activates/deactivates pressure generator 1024 in substantially the same manner as described above to inflate and deflate sleeve 1052 of assembly 1036. However, pressurized fluid moves through conduit 1010 of apparatus 1032 during inflation and deflation of sleeve 1052 in addition to the other conduits of system 1030. The direction of movement of pressurized fluid through conduit 1010 is dependent upon whether sleeve 1052 is being inflated or deflated. In those embodiments having a plurality of valves 1026 for controlling inflation/deflation of a plurality of bladders or sections of a sleeve assembly, apparatus 1032 comprises a plurality of conduits 1010 routed therethrough.

Due to the added volume of conduit 1010, the time to inflate sleeve 1052 may increase when sleeve is inflated through conduit 1010. To compensate for the added volume of conduit 1010, some embodiments of module 1034 may have a dual speed or multi-speed pressure generator that operates at a higher speed to increase the volume flow rate of pressurized fluid when sleeve is inflated through conduit 1010. In such embodiments, a suitable sensor may be provided, such as in coupler 1012, for example, to provide a mode signal to circuit 1020 which indicates whether coupler 1012 has coupler 1016 of sleeve assembly 1036 coupled thereto or whether coupler 1012 has coupler 1014 of apparatus 1032 coupled thereto. The speed of pressure generator 1024 is then adjusted or selected accordingly by circuit 1020 based on the mode signal. In other embodiments, a user may input an inflation time parameter into circuit 1020 and circuit 1020 will adjust the operation of pressure generator 1024 to achieve the desired inflation time that is input by the user.

Figure 12:
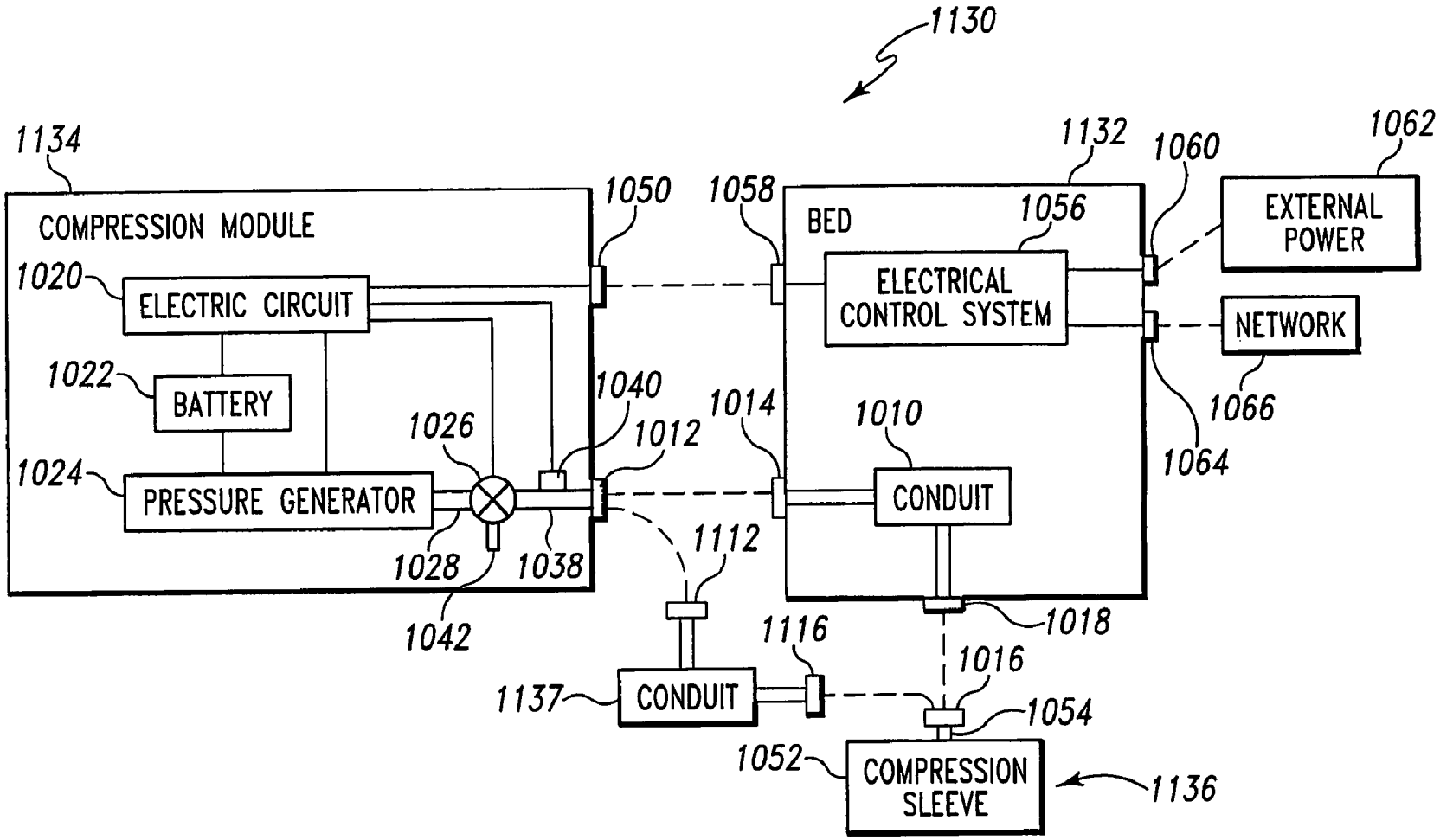
FIG. 12 is a block diagram showing a bed having an electrical control system and a conduit routed therethrough, a compression module that is coupleable to the bed, an additional conduit that is coupleable to the compression module, a compression sleeve that is selectively coupleable to the bed and to the additional conduit, and an electric circuit of the compression module being coupled to an external power source and to a network of computer devices via the electrical control system of the bed.

A compression therapy system 1130, which is similar to system 1030, comprises a bed 1132, a compression module 1134, a compression sleeve assembly 1136, and an additional conduit 1137 as shown diagrammatically in FIG. 12. Portions of system 1130 which are substantially the same as like portions of system 1030 are denoted with like reference numerals. One difference between system 1130 and system 1030 is the inclusion of additional conduit 1137 in system 1130. Conduit 1137 has a first coupler 1112 that is coupleable to coupler 1012 of module 1134 and a second coupler 1116 that is coupleable to coupler 1016 of compression sleeve assembly 1136. Conduit 1054 of illustrative assembly 1136 is shorter than conduit 1054 of assembly 1036. Although conduit 1137 is illustrated as a single conduit through which sleeve 1052 is inflated and deflated, it is within the scope of this disclosure for a plurality of conduits 1137 to be provided in system 1130 for inflating and deflating a plurality of sleeves or a plurality of different sections of a sleeve. In such embodiments, the plurality of conduits 1137 may be coupled together to form a ribbon of conduits and, furthermore, multi-port couplers may be provided at the ends of such a ribbon for coupling to appropriately configured couplers 1012, 1016.

The volume of the internal flow passage of conduit 1137 may be substantially equivalent to the volume of the internal flow passage of conduit 1010 which is routed through bed 1132. In such an embodiment, when pressure generator 1024 operates at a particular speed to produce a particular volume flow rate of pressurized fluid, compression sleeve 1052 will generally inflate to a target pressure within a particular period of time regardless of whether module 1134 operates to inflate sleeve 1052 through conduit 1010 of bed 1132 or through conduit 1137. Thus, a single speed pressure generator 1024 may be acceptable for use in some embodiments of module 1134 to achieve desired inflation of sleeve 1052. Of course, a pressure generator 1024 having a controllable speed may be provided in module 1134, if desired.

Another difference between system 1130 and system 1030 is that module 1134 of system 1130 has an electrical coupler 1050 and bed 1132 has an electrical coupler 1058 that mates with coupler 1050 when module 1134 is coupled to bed 1132. Coupler 1050 is coupled via suitable electrical conductors to circuit 1020 of module 1134 and coupler 1058 is coupled via suitable electrical conductors to an electrical control system 1056 of bed 1132. Bed 1132 also has a power coupler 1060 configured to couple to external power source 1062 and a network coupler 1064 configured to couple to a network 1066 of computer devices. Coupler 1060 is coupled to the electrical control system 1056 of bed 1132 via suitable electrical conductors and coupler 1064 is also coupled to the electrical control system 1056 of bed 1132 via suitable electrical conductors.

When module 1134 is coupled to bed 1132, power for operating circuit 1020 and pressure generator 1024 may be provided from external power source 1062 through the electrical control system 1056 of bed 1132. In addition, the power from external power source 1062 may be used to recharge battery 1022 of module 1134 when module 1134 is coupled to bed 1132. Furthermore, data may be communicated between network 1066, the electrical control system 1056 of bed 1132, and electric circuit 1020 of module 1134 when module 1134 is coupled to bed 1132. Such data may include various operating parameters and alarm conditions of module 1134 and/or bed 1132.

Figure 13:
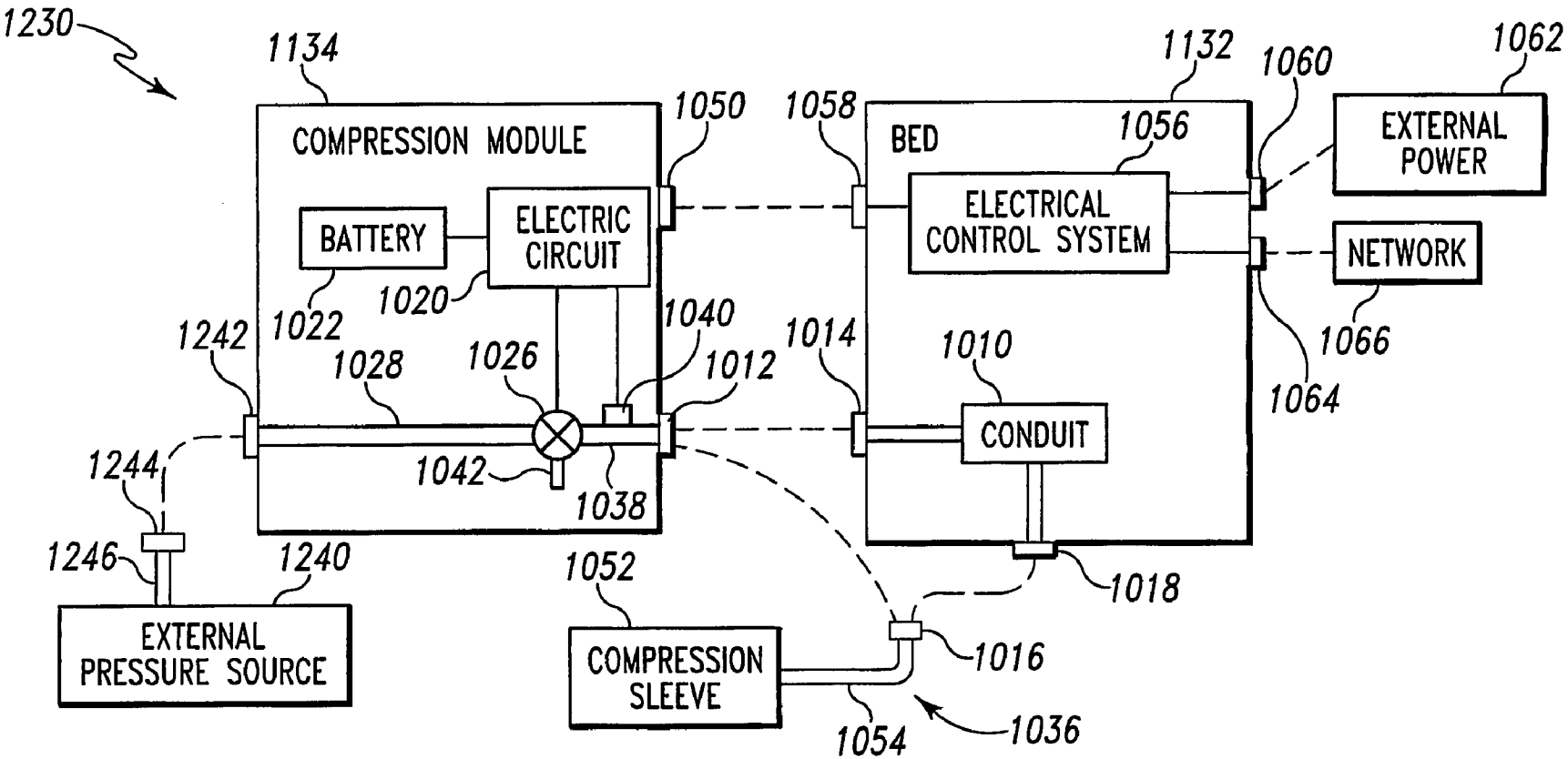
FIG. 13 is a block diagram showing a bed having an electrical control system and a conduit routed therethrough, a compression module that is coupleable to the bed and to an external pressure source, a compression sleeve that is selectively coupleable to the bed and to the compression module, and an electric circuit of the compression module being coupled to an external power source and to a network of computer devices via the electrical control system of the bed.

Yet another compression therapy system 1230, which has features that are similar to features of systems 1030, 1130, comprises sleeve assembly 1036, bed 1132, and an alternative compression module 1234 as shown diagrammatically in FIG. 13. Portions of system 1230 which are substantially the same as like portions of systems 1030, 1130 are denoted with like reference numerals. The main difference between system 1230 and systems 1030, 1130 is that module 1234 does not have a pressure generator, but rather, pressurized fluid is provided to module 1234 from an external pressure source 1240. Such a pressure source 1240 may include, for example, a separate pump or compressor situated in a portable housing that is located nearby module 1234 or that detachably mounts to module 1234 to be transported therewith. Such a pressure source 1240 may also include, for example, a medical gas system of a healthcare facility having remote source equipment, such as one or more pump units or compressor units located in a maintenance room, and a series of pipes or other types of conduits that are routed from the source equipment to various gas outlets located throughout the healthcare facility. Any type of device or equipment capable of producing pressurized fluid is considered to be a "pressure source" in accordance with this disclosure.

Module 1234 has a source coupler 1242 to which is coupled a coupler 1244 that is situated at an end of a conduit 1246 extending from external pressure source 1240 as shown diagrammatically in FIG. 13. Conduit 1246 may be, for example, a pneumatic line or hose that extends between a gas outlet in a hospital room and module 1234. In such an embodiment, another coupler (not shown) may be provided at an end of conduit 1246 for coupling to the gas outlet associated with external pressure source 1240. In some embodiments, coupler 1244 includes a valve or other similar structure that closes an associated flow passage and/or port of coupler 1244 when coupler 1244 is decoupled from coupler 1242. Such a valve or similar structure moves to an opened position in response to coupling of coupler 1244 to coupler 1242 to permit pneumatic communication between external pressure source 1240 and an internal conduit 1228 of module 1234. Conduit 1228 extends within module 1234 between coupler 1242 and valve 1026.

When external pressure source 1240 is coupled to module 1234, circuit 1020 signals valve 1042 to open and close according to a control algorithm to inflate compression sleeve 1052 of compression sleeve assembly 1036 either directly, if assembly 1036 is coupled to module 1234, or through conduit 1010 of bed 1132, if module 1234 and assembly 1036 are coupled to bed 1132. In the illustrative example, circuit 1020 of module 1234 may receive power from external power source 1062 and communicates with network 1066 through the electrical control system 1056 of bed 1132. If module 1234 does not receive power from external power source 1062, such as is the case when power source 1062 is disconnected from bed 1132, then battery 1022 supplies the power necessary to operate circuit 1020 and associated components of module 1234, such as valve 1026 and sensor 1040. Bed 1132 may also have an onboard battery (not shown) to operate the electrical control system 1056 and associated components when bed 1132 is disconnected from external power source 1062.

Figure 14:
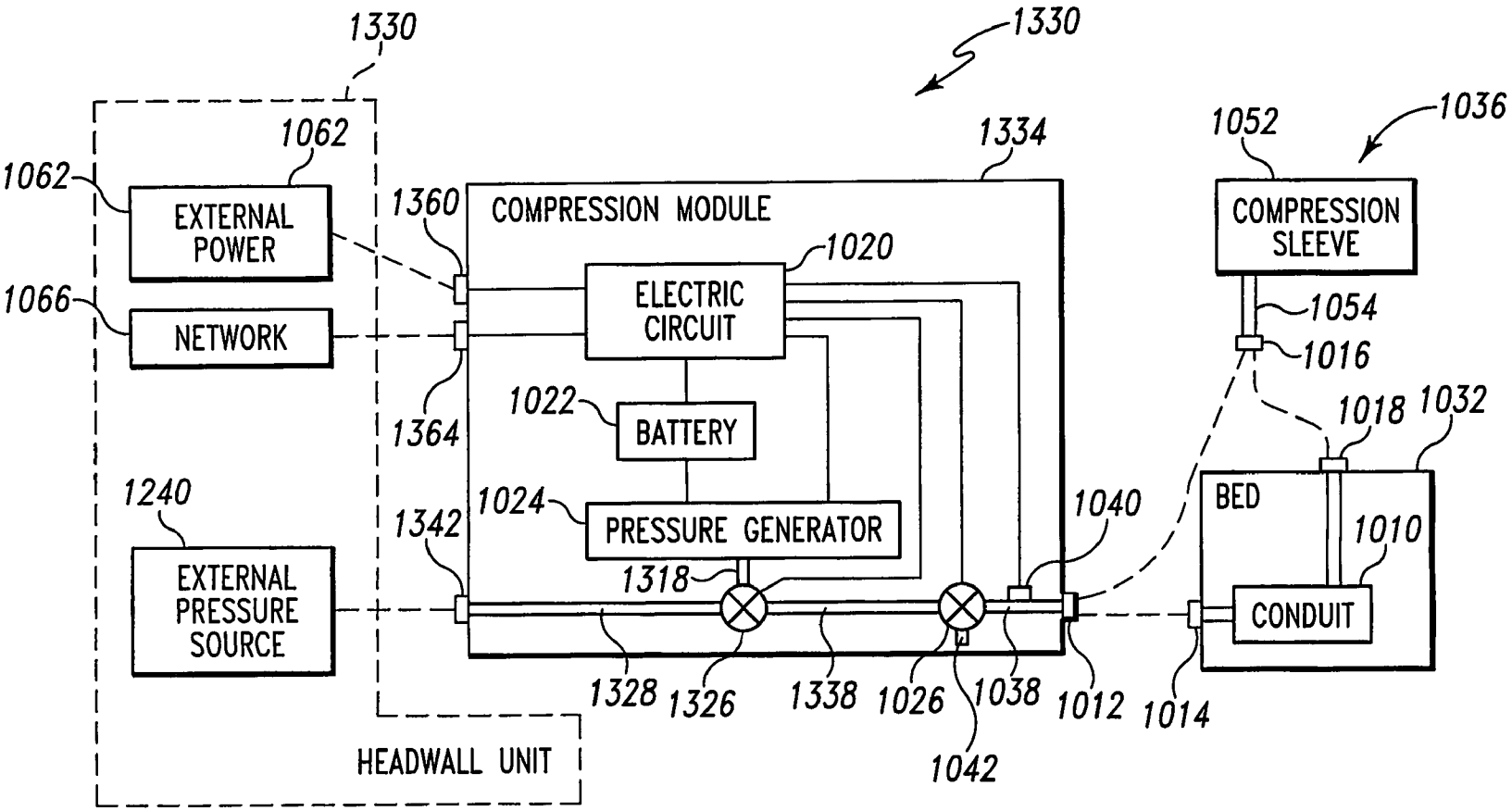
FIG. 14 is a block diagram showing a bed having a conduit routed therethrough, a compression module that is coupleable to the bed and to a headwall, a compression sleeve that is selectively coupleable to the bed and to the compression module, and the headwall unit having outlets for connecting the compression module to an external power source, to the network, and to an external pressure source.

A further compression therapy system 1330 according to this disclosure, which has features similar to systems 1030, 1130, 1230, comprises patient-support apparatus 1032, compression sleeve assembly 1036, and an alternative compression module 1334 as shown diagrammatically in FIG. 14. Portions of system 1330 which are substantially the same as like portions of systems 1030, 1130, 1230 are denoted with like reference numerals. Although patient-support apparatus 1036 is labeled as "bed" in FIG. 14, other types of patient-supports devices, as mentioned herein, may be included in system 1330.

Module 1334 has its own pressure generator 1024 and also has a coupler 1342 that is coupleable to external pressure source 1240. Module 1334 further comprises a selector or valve 1326 that is coupled pneumatically to coupler 1342 by a conduit 1328 and that is coupled pneumatically to valve 1026 by a conduit 1338. In addition, module 1334 has a conduit 1318 extending from an outlet of pressure generator 1024 to valve 1326. In alternative embodiments, a manually actuated valve is provided in module 1334 to serve as a selector in lieu of electrically actuated valve 1326. The position of such a manually actuated valve may be determined by a handle, knob, lever, or the like that is moved by a user. Alternatively, such a manually actuated valve may be moved mechanically to the appropriate position as a result of external pressure source 1240 being coupled to coupler 1342 or decoupled from coupler 1342.

Valve 1326 of illustrative system 1330 is an electrically actuated valve that is movable between first, second, and third positions in response to one or more control signals received by valve 1326 from circuit 1020 of module. When valve 1326 is in the first position, pneumatic communication between pressure generator 1024 and conduit 1338 is blocked and pneumatic communication between pressure source 1240 and conduit 1338 is blocked. When valve 1326 is in the second position, pressure generator 1024 is in pneumatic communication with conduit 1338 and pneumatic communication between pressure source 1240 and conduit 1338 is blocked. When valve 1326 is in the third position, pressure source 1240 is in pneumatic communication with conduit 1338 and pneumatic communication between pressure generator 1024 and conduit 1338 is blocked.

When valve 1026 is moved to the inflation position and valve 1326 is moved to the second position, operation of pressure generator 1024 results in the inflation of sleeve 1052 of assembly 1036 either directly, if assembly 1036 is coupled to module 1334, or through conduit 1010 of bed 1032. When valve 1026 is moved to the inflation position and valve 1326 is moved to the third position, pressure source 1240 supplies pressurized fluid through module 1334 to inflate sleeve 1052 of assembly 1036 either directly, if assembly 1036 is coupled to module 1334, or through conduit 1010 of bed 1032. Valves 1026, 1326 may be mounted to a common manifold such that one or more of conduits 1038, 1042, 1318, 1328, 1338, or portions thereof, are provided by passages formed in the manifold.

Module 1334 has an electrical coupler or connector 1360 which is configured for coupling to external power 1062 as shown in FIG. 14. Module 1334 also has an electrical coupler or connector 1364 which is configured for coupling to network 1066. Couplers 1360, 1364 are coupled via suitable electrical conductors to electric circuit 1020 of module 1334. Thus, unlike modules 1134, 1234 of systems 1130, 1230, respectively, module 1334 communicates directly with network 1066 rather than through the electrical control system, if any, of the associated patient-support apparatus 1032. In addition, module 1334 receives power directly from external power 1062 instead of through the electrical system, if any, of the associated patient-support apparatus.

In the illustrative embodiment of system 1330, module 1334 is coupleable to a headwall unit 1330 as shown diagrammatically in FIG. 14. Headwall unit 1330 may include outlets or connectors (not shown) that provide connectivity between module 1334 and external power 1062, network 1066, and external pressure source 1240. Although blocks 1062, 1066, 1240 are illustrated diagrammatically as being surrounded by headwall 1330, it should be understood that the components and systems associated with blocks 1062, 1066, 1240 are not physically located, in their entirety, within headwall 1330, but rather, headwall 1330 provides module 1334 with connectivity to these various systems. Although module 1334 of system 1330 is described as being coupleable to headwall 1330 and although module 34 is described above as being coupleable to headwall unit 200, it is within the scope of this disclosure for modules 34, 1334 (or any of the other compression modules disclosed herein) to be coupleable to other types of architectural structures used in healthcare facilities. Such architectural structures may include, for example, columns that extend either partially or fully between a floor and a ceiling; chases that are mounted to a wall, a ceiling, or some other structure; arms that are suspended from a ceiling, a wall, a floor-supported frame, or some other structure; pedestals that are mounted to or otherwise rest upon a floor or some other structure; and carts, such as stand-alone carts, carts that are dockable to a patient-support apparatus, and carts that are dockable to some other structure.

Figure 15:
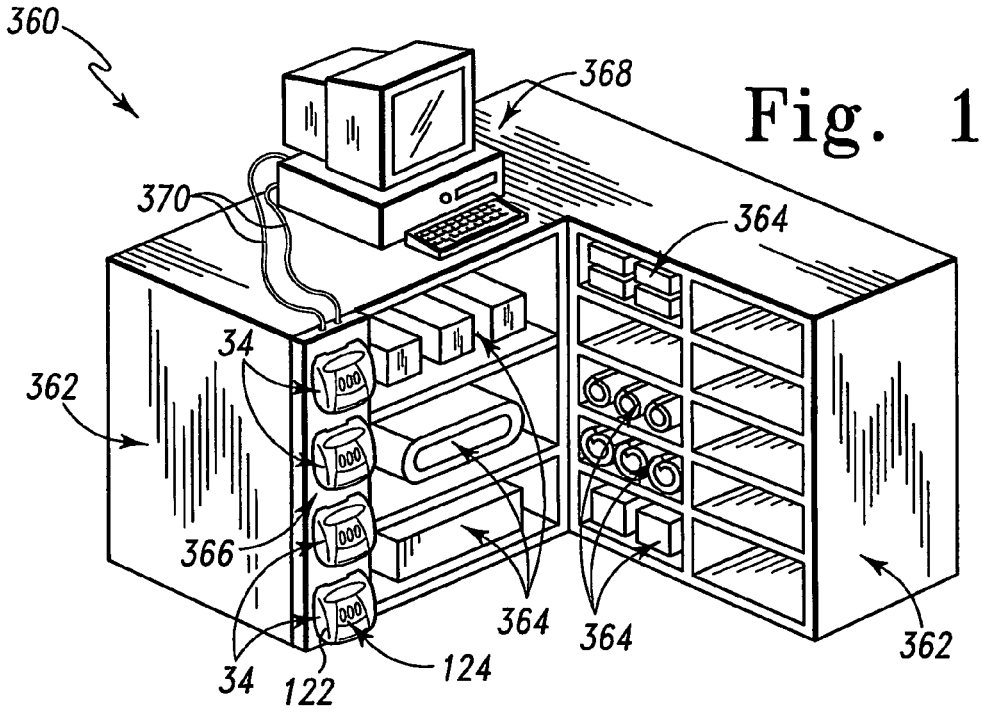
FIG. 15 is a perspective view of a supply-storage station showing a plurality of compression modules coupled communicatively to a computer to download data thereto or to receive data, such as software upgrades, therefrom.

Referring now to FIG. 15, an illustrative supply-storage station 360 has storage shelves 362 on which various supplies 364, such as compression sleeve assemblies 36, 1036, compression modules 34, 234, 1034, 1134, 1234, 1334, spare parts for modules 34, 234, 1034, 1134, 1234, 1334, and/or other supplies may be stored, as desired. Station 360 has a device 366 to which modules 34 are mounted for recharging and/or communicating data to and/or from a computer 368 of station 360. Computer 368 may be coupled to the network of the healthcare facility or may be a stand-alone computer. Electrical conductors 370 extend between device 366 and computer 368. In some embodiments, data is downloaded from modules 34 to computer 368 through device 366 and data from computer 368, such as operating software upgrades, is uploaded to modules 34 through device 366. Illustrative device 366 comprises a board or substrate 372 and a set of electrical connectors (not shown) that are supported with respect to board 372 at appropriate locations to mate with the electrical connectors of modules 34. Illustrative device 366 is configured to accommodate up to four modules 34. In alternative embodiments, device 366 may be configured to accommodate more or less than four modules 34.

Figure 16:
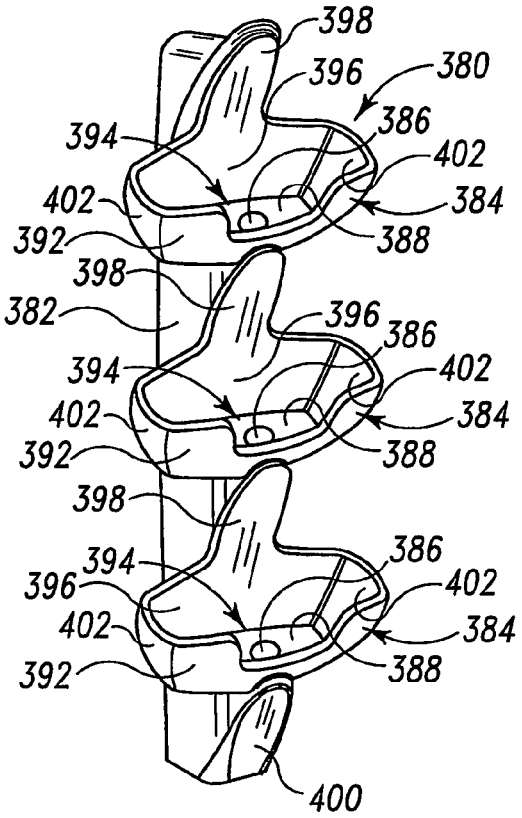
FIG. 16 is a perspective view of a module-recharging apparatus showing a vertical recharging stick and three module-receiving cradles coupled to the recharging stick.

Referring now to FIG. 16, a module-recharging apparatus 380 comprises a vertical recharging stick 382 and three module-receiving cradles 384 coupled to the front of recharging stick 382. Cradles 384 are configured to receive and support modules 34 therein. A set of prongs (not shown) extend from the rear of stick 382 and are configured for receipt in a standard electrical plug or receptacle. Suitable conductors, such as wires, extend through the interior region of stick 382 between the set of prongs and respective electrical connectors 386 which are located on associated bottom walls 388 of cradles 384. AC to DC conversion circuitry is provided in the interior region of stick 382, in some embodiments, to convert the standard AC power received by the prongs of apparatus 380 into a predetermined DC voltage for application to modules 34 through connectors 386. In other embodiments, each module 34 has its own AC to DC conversion circuitry receives standard AC power via connectors 386.

Illustrative cradles 384 are configured to receive the lower portion of modules 34 therein. A front wall 392 of each cradle 384 is formed with a cutout 394 through which user inputs 124 of modules 34 are accessible when modules 34 are mounted to cradles 384. Cradles 384 are tilted slightly forwardly relative to stick 382 such that the front face of modules 34 faces slightly toward the floor when modules 34 are situated therein. A back wall 396 of each cradle 384 has an upwardly extending lobe or protrusion 398. The lobes 398 of the two lower cradles 384 overlap a small portion of the front walls 392 of the next successive cradles 384 situated thereabove. Wires are routed to the two upper connectors 386 through spaces provided behind the two lower lobes 398. Stick 382 has an enlarged lower end 400 through which wires are routed to the lower connector 386. Each cradle 384 has a pair of side walls 402 extending between the respective front walls 392 and back walls 396.

Although module 34 has been described above as being part of various compression therapy systems used primarily in healthcare environments, module 34 and the associated compression therapy systems may be used in other environments as well. For example, compression therapy systems including module 34 and sleeve assemblies 36 may be used to promote blood flow in the legs of passengers on long flights, train rides, bus rides, etc. In addition, truck drivers, taxi drivers, airline pilots, etc. may use such compression therapy systems to promote blood flow in their legs. Just about any person who wishes to promote blood flow in their legs may do so in just about any location due to the portability of module 34 and sleeve assemblies 36.

Figure 17:
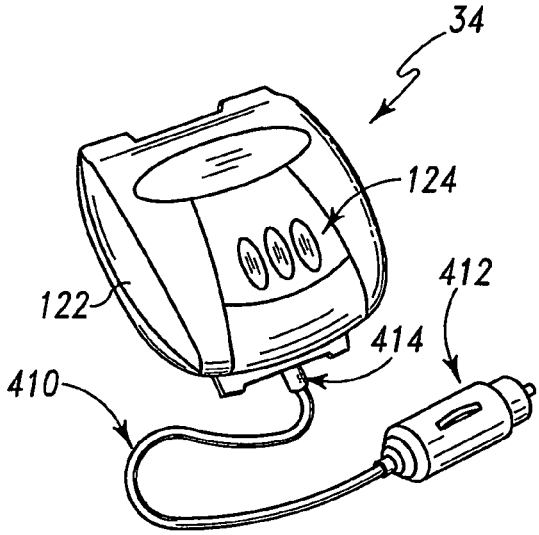
FIG. 17 is a perspective view showing of one of the compression modules which is configured to receive power from a power cord that plugs into a lighter socket of an automotive vehicle.

In the case of bus drivers, taxi drivers, or anyone else traveling in an automotive vehicle who wishes to use module 34 to control inflation/deflation of one or more sleeve assemblies 36 coupled to their legs and/or feet, a power cord 410, shown in FIG. 17, that plugs into a standard lighter socket of an automotive vehicle may be used to provide power to module 34. Power cord 410 has a lighter plug 412 at one end thereof and a module plug 414 at the opposite end thereof. Lighter plug 412 is configured for receipt in a standard lighter socket to receive power from the electrical system of the associated automotive vehicle. Module plug 414 is releasably coupleable to the electrical connector of module 34. Use of power cord 410 to provide power to module 34 conserves the charge of any batteries of module 34. In some embodiments, the batteries of module 34 are recharged when power cord 410 is used to provide power to module 34.

Figure 18:
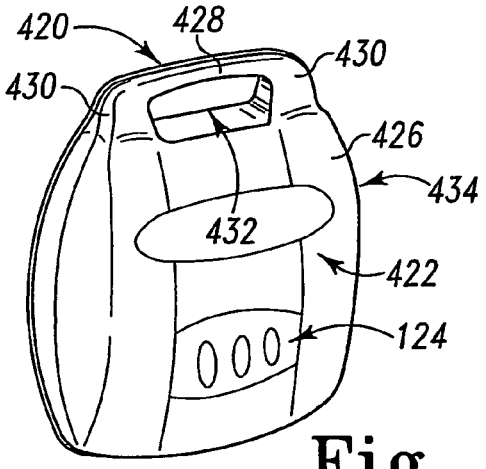
FIG. 18 is a perspective view of an alternative compression module having a housing with a carrying handle molded integrally therewith.

Referring now to FIG. 18, an alternative compression module 434, which is similar to module 34, has a housing 422 with a carrying handle 420 molded integrally with a main portion 426 of housing 422. As was the case with module 34, module 434 has user inputs 124 for providing operating parameters to the circuitry of module 434 to control the inflation/deflation of the associated compression sleeve assemblies 36. Handle 420 comprises a grippable portion 428 and a pair of connector portions 430 interconnecting portions 426, 428. Connector portions 430 support grippable portion 428 in spaced relation with main portion 426 so that a finger-receiving opening 432 is defined between portions 426, 428. Opening 432 is sized to receive one or more of a user's fingers. Thus, a user is able to grip handle 420 to carry module 434.

Figure 19:
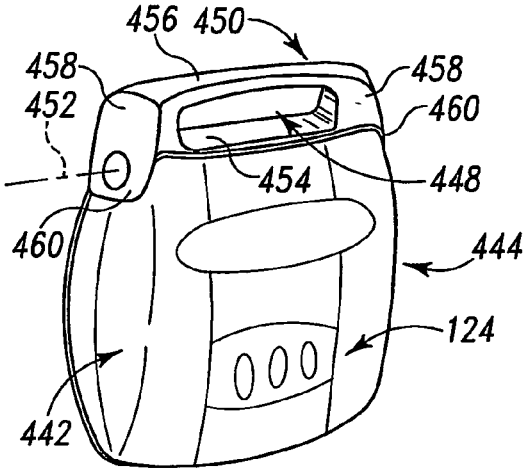
FIG. 19 is a perspective view of another alternative compression module having a pivotable carrying handle coupled to a housing of the compression module.

Another alternative compression module 444 has a housing 442 to which a separate carrying handle 450 is coupled for pivoting movement about an axis 452 as shown in FIG. 19. Handle 450 comprises a base portion 454, a grippable portion 456, and a pair of connector portions 458 interconnecting portions 454, 456. Handle 450 further comprises a pair of pivot flanges 460 extending downwardly from portion 454. Flanges 460 are situated alongside the opposite sides of housing 442 of module 444. A set of pivot pins (not shown) or other suitable structure for permitting handle 450 to pivot relative to housing 442 are provided. In some embodiments, the pivot structure associated with flanges 460 comprises a set of cylindrical or hemispherical projections that are received in complimentary shaped pockets or detents formed in housing 442. Such projections and detents may be sized to permit handle 450 to snap onto and off of housing 442. Connector portions 458 support grippable portion 456 in spaced relation with base portion 454 so that a finger-receiving opening 448 is defined between portions 454, 456. Opening 448 is sized to receive one or more of a user's fingers. In alternative embodiments of handle 450, base portion 454 is omitted.

Figure 20:
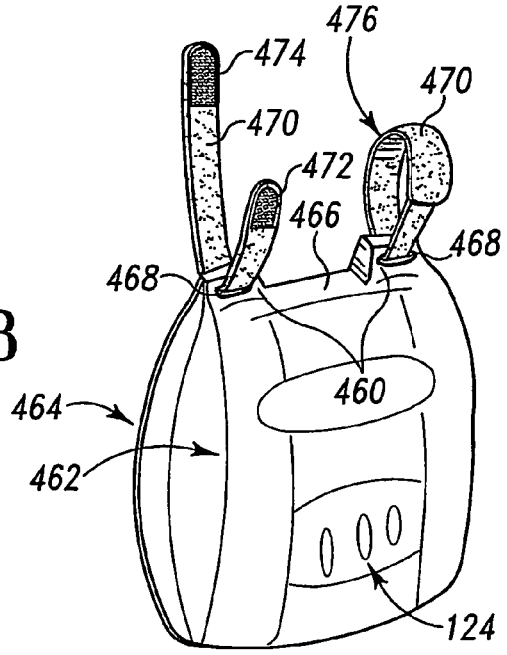
FIG. 20 is a perspective view of a further alternative compression module having a housing with loop-receiving eyelets molded integrally therewith and showing a pair of flexible loops that are coupled to respective loop-receiving eyelets.

A further alternative compression module 464 has a housing 462 with a pair of loop-receiving eyelets 460 molded integrally with a top wall 466 of housing 462 as shown in FIG. 20. Each eyelet 460 has a slot or opening through which respective flexible straps 470 may be threaded. Each strap 470 has fastened to the opposite ends thereof suitable couplers, such as an illustrative loop material patch 472 and a hook material patch 474. After strips 470 are threaded through openings 468 of eyelets 460, strips may be routed around other structures, such as a portion of a siderail of a bed, an armrest of a wheel chair, a handle of a nightstand, a belt worn by a user, etc., and the loop material patch 472 may then be fastened to the hook material patch 474 so that straps 470 form loops 476 which couple module 464 to the structure. Snaps, clips, or the like may be used as couplers on straps 470 in lieu of the illustrative hook-and-loop material arrangement.

Figure 21:
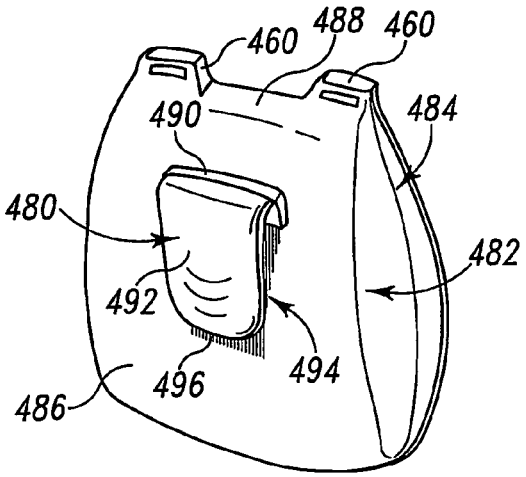
FIG. 21 is a perspective of yet another alternative compression module showing a belt clip molded integrally with a housing of the compression module.

Yet another alternative compression module 484 has a housing 482 with a belt clip 480 molded integrally with a back wall 486 of housing 482 as shown in FIG. 21. In alternative embodiments, belt clip 480 is a separate piece that is removably attachable to back wall 486 via suitable coupling mechanisms, such as a tongue-in-groove arrangement, fingers, snaps, tabs, or the like. Illustrative housing 482 has a pair of eyelets 460 formed integrally with a top wall 488 of housing 482. Eyelets 460 of module 484 are substantially identical to eyelets 460 of module 464. In alternative embodiments, eyelets 460 are omitted from module 484.

Belt clip 480 has a first flange 490 that extends substantially horizontally away from back wall 486 by a small amount and a second flange 492 that extends downwardly from flange 490 as shown in FIG. 21. Flange 492 has a distal free end 496. Flange 492 is spaced from, but substantially parallel with, back wall 486 to define a belt-receiving space 494 therebetween. Thus, belt clip 480 is configured to permit module 484 to be clipped onto a user's belt such that housing 482 is situated on one side of the user's belt, flange 490 extends over the top of the user's belt, and flange 492 is situated on an opposite side of the user's belt.

Figure 22:
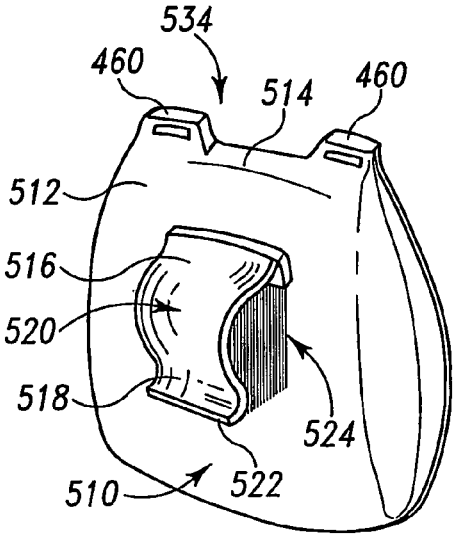
FIG. 22 is a perspective view of still another alternative compression module showing a clip that is molded integrally with a housing of the compression module and that is configured to couple the compression module to a horizontally extending tube.

Still another alternative compression module 534 has a housing 510 with a tube clip 520 molded integrally with a back wall 512 of housing 510 as shown in FIG. 22. In alternative embodiments, tube clip 520 is a separate piece that is removably attachable to back wall 486 via suitable coupling mechanisms, such as those mentioned above in connection with belt clip 480. Illustrative housing 510 also has eyelets 460 formed integrally with a top wall 514 of housing 510. Eyelets 460 of module 534 are substantially identical to eyelets 460 of module 464. In alternative embodiments, eyelets 460 are omitted from module 534.

Figure 24:
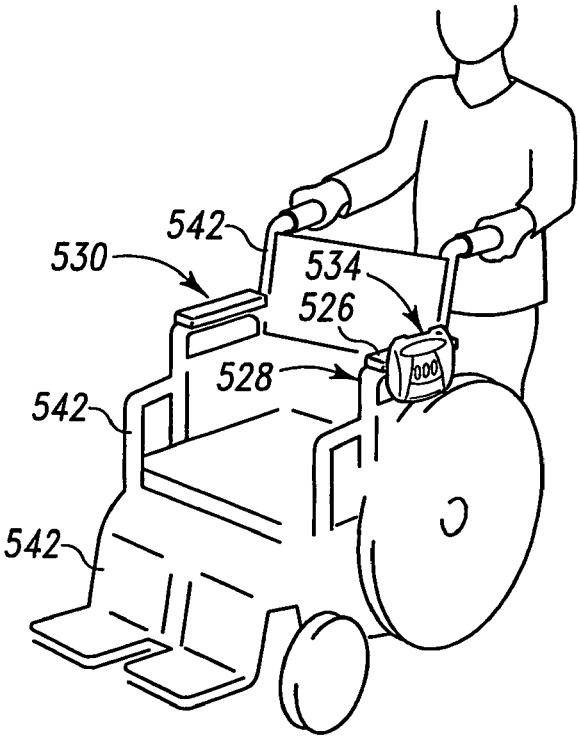
FIG. 24 is a perspective view showing a compression module coupled to an armrest of a wheelchair to be transported therewith.
Figure 25:
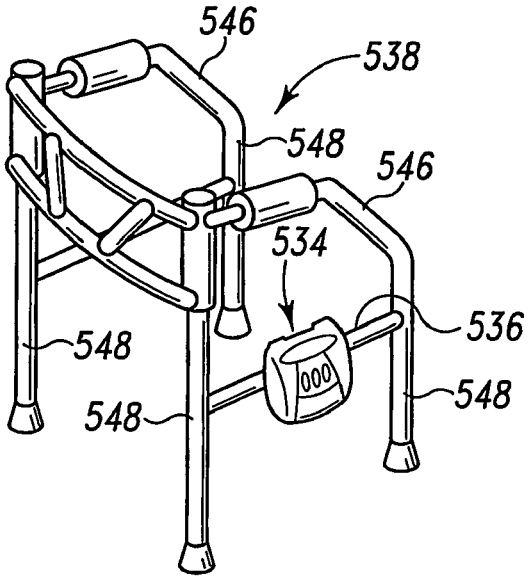
FIG. 25 is a perspective view showing a compression module coupled to a horizontal tube of a walker to be transported therewith.

Tube clip 520 is generally serpentine in vertical cross section, having a curved, first flange 516 that is coupled at its upper end to back wall 512 and having a curved, second flange 518 that is appended to the lower end of flange 516. The outer surface of flange 516 faces away from back wall 512 and is generally convex, whereas the outer surface of flange 518 faces away from back wall 512 and is generally concave. Flange 518 has a distal free end 522. Flange 516 is spaced from back wall 512 to define a tube-receiving space 524 therebetween. Thus, tube clip 520 is configured to permit module 534 to be clipped onto a tube or other similar structural member such that housing 510 is situated on one side of the tube and such that flange 516 wraps partially around the tube with a friction fit engagement. For example, tube clip 520 may be used to mount module 534 to a horizontal portion 526 of an armrest 528 of a wheelchair 530 to be transported therewith as shown in FIG. 24. As another example, clip 520 may be used to mount module 534 to a horizontal tube 536 of a walker 538 to be transported therewith as shown in FIG. 25. Clip 520 may also be used to mount module 534 to other structural members of all sorts of other devices, including a siderail of a hospital bed.

Figure 23:
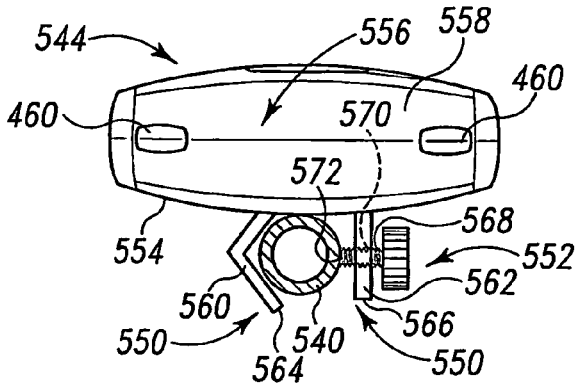
FIG. 23 is a top plan view of a yet a further alternative compression module having a pair of flanges and a knob that are configured to couple the compression module to a vertically extending pole.
Figure 26:
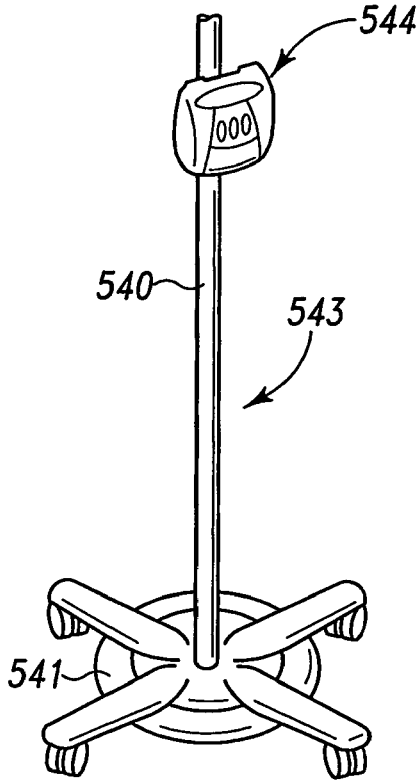
FIG. 26 is a perspective view showing a compression module coupled to a vertical IV pole extending upwardly from a wheeled base.

Yet a further alternative compression module 544 according to this disclosure has a pair of flanges 550 and a knob 552 that are configured to couple the compression module 544 to a vertically extending tube or pole 540, such as an IV pole 540 that extends upwardly from a base 541 of a wheeled IV stand 543 as shown in FIGS. 23 and 26. Flanges 550 and knob 552 may also be used to mount module 544 to any of the various vertical frame members 542 of wheelchair 530, shown in FIG. 24, or to any of the various portions of legs 548 of walker 538, shown in FIG. 25, including inclined portions 546 of legs 548.

Flanges 550 extend away from a back wall 554 of a housing 556 of module 554 as shown in FIG. 23. Optionally, a top wall 558 of housing 556 has eyelets 460 molded integrally therewith. One of illustrative flanges 550 is a V-shaped flange 560 and the other of flanges 550 is a straight flange 562. The spacing between an outer vertical edge 564 of flange 560 and an outer vertical edge 566 of flange 562 is large enough to permit tube 540 to pass therebetween. Knob 552 has a threaded shaft 568 that threads through a threaded aperture 570 formed in flange 562. When pole 540 is located between flanges 560, 562, knob 552 may be tightened so that pole 540 is clamped between an end 572 of threaded shaft 568 and the segments of flange 560 forming the V-shape with enough force to hole module 544 in place relative to pole 540. Of course, knob 562 may be loosened to permit decoupling of module 544 from pole 540.

Figure 27:
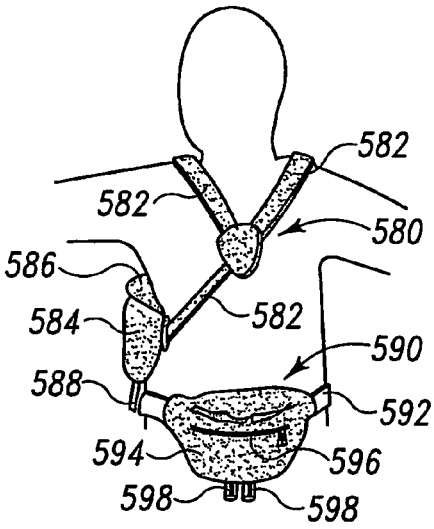
FIG. 27 is perspective view showing a person wearing a shoulder harness having a pouch in which a first compression module is carried and wearing a fanny pack having a pouch in which a second compression module is carried.
Figure 28:
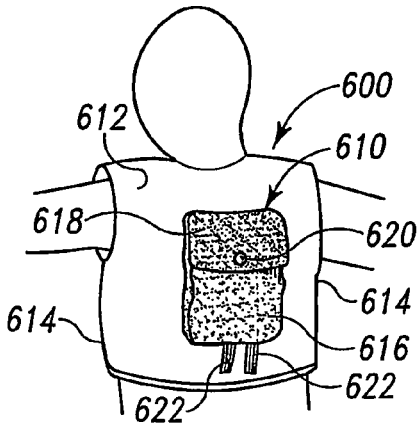
FIG. 28 is a perspective view showing a person wearing a vest having a pocket in which a compression module is carried.
Figure 29:
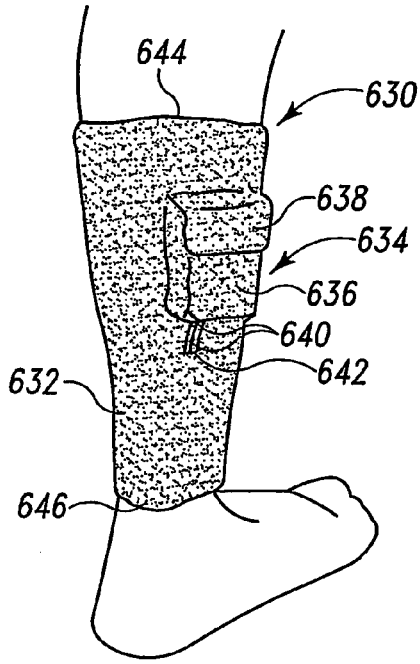
FIG. 29 is a perspective view showing a compression sleeve coupled to a calf of a person and showing the compression sleeve having a pocket in which a compression module for inflating the compression sleeve is carried.

Referring now to FIGS. 27-29, a variety of module-carrying garments are configured to be worn by a person and are configured to carry a compression module, such as any of those described above. One such garment comprises a shoulder harness 580 having a set of straps 582 and a pouch 584 coupled to straps 582 as shown in FIG. 27. Straps 582 are configured so that pouch 584 is located at the person's side between one of the person's arm pits and hips. Harness 580 has a top flap 586 which is moved to open and close an open top (not shown) of pouch 584. Suitable closure mechanisms, such as zippers, hook-and-loop patches, snaps, and the like, may be provided at the interface between flap 586 and pouch 584. Pouch 584 is sized and configured to receive a compression module therein. In addition, a bottom panel (not shown) of pouch 584 has one or more openings through which one or more conduits 588 may extend. The one or more openings in the bottom panel of pouch 584 are small enough, however, to prevent the entire compression module from falling therethrough. Pressurized fluid is communicated through conduits 588 between the module carried in pouch 584 and the compression sleeve(s) coupled to the person's limb(s).

Another garment for carrying a compression module comprises a fanny pack 590 having a belt 592 that extends around a person's waist and a pouch 594 coupled to the belt 592 as shown in FIG. 27. Pouch 594 is sized and configured to receive a compression module therein. Although the person in FIG. 27 is illustrated as wearing both a harness 580 and a fanny pack 590, it should be appreciated that, if desired, only one of harness 580 and fanny pack 590 may be worn without wearing the other. A zipper 596 is coupled to pouch 594 for opening and closing a slot (not shown) of pouch 594 through which compression modules may be inserted into or removed from pouch 594. A bottom panel (not shown) of pouch 584 has one or more openings through which one or more conduits 598 may extend. The one or more openings in the bottom panel of pouch 594 are small enough, however, to prevent the entire compression module from falling therethrough. Pressurized fluid is communicated through conduits 598 between the module carried in pouch 594 and the compression sleeve(s) coupled to the person's limb(s).

A further garment according to this disclosure comprises a vest 600 having a pocket 610 in which a compression module is carried. In the illustrative embodiment, pocket 610 is situated on a back portion 612 of vest 600. In other embodiments, pocket 612 is situated on one of the side portions 614 or on a front portion (not shown) of vest 600. Pocket 610 includes a lower, main portion 616 and a flap 618 that is moved to open and close an open top (not shown) of main portion 616. Compression modules are insertable into and removable from portion 616 of pocket 610 when flap 618 is in an opened position. Suitable closure members, such as an illustrative snap 620, is provided to maintain flap 618 in the closed position to retain the compression module in pocket 610. A bottom panel (not shown) of main portion 616 of pocket 610 has one or more openings through which one or more conduits 622 may extend. The one or more openings in the bottom panel of main portion 616 are small enough, however, to prevent the entire compression module from falling therethrough. Pressurized fluid is communicated through conduits 622 between the module carried in pocket 610 and the compression sleeve(s) coupled to the person's limb(s).

A compression sleeve 630, which is configured to couple to a person's calf, has a main sleeve portion 632 and a pocket in which a compression module for inflating the compression sleeve is carried. Sleeve 630 wraps around the person's calf and has one or more inflatable bladders or chambers that inflate to promote blood flow. In some embodiments, sleeve 630 is configured as a tube that slips onto the person's leg. In other embodiments, sleeve 630 has one or more flaps or straps that releasably attach to other portions of the sleeve 630 via suitable couplers, such as hook-and-loop fasteners, snaps, or the like. Alternative sleeves which couple to other portions of a person's limbs, such as sleeves for a person's arms, combination thigh and calf sleeves, combination calf and foot sleeves, sleeves that cover substantially all of a person's leg, and foot sleeves, may have a pocket for carrying a compression module in accordance with this disclosure.

Pocket 634 includes a lower, main portion 636 and a flap 638 that is moved to open and close an open top (not shown)

of main portion 636. Compression modules are insertable into and removable from portion 636 of pocket 634 when flap 638 is in an opened position. Suitable closure members, such as hook-and-loop patches, are provided to maintain flap 638 in the closed position to retain the compression module in pocket 634. A bottom panel (not shown) of main portion 636 of pocket 634 has one or more openings through which one or more conduits 640 may extend. The one or more openings in the bottom panel of main portion 636 are small enough, however, to prevent the entire compression module from falling therethrough. In the illustrative embodiment, two conduits 640 are shown extending from pocket 634, which implies that sleeve 630 has two inflatable chambers. These two conduits 640 extend through a slit 642 formed in an outer layer of portion 632 of sleeve 630 and are routed through portion 632 to respective chambers of sleeve 630. In alternative embodiments, all portions of conduits 640 are located on the outside of main portion 632 and communicate with respective chambers of sleeve 630 through ports that extend from the external surface of the outer layer of main portion 632.

Pressurized fluid is communicated through conduits 640 between the module carried in pocket 634 and the chambers of main portion 632. The compression modules used with sleeve 630 are smaller in size than other compression modules disclosed herein. Due to the shorter length of conduits 640, as compared to the conduits of other compression therapy systems described herein, a smaller capacity pressure generator may be used in the compression modules configured for receipt in pocket 634. In addition, less valves are needed in the compression modules used with sleeve 630 due to the fact the compression module is dedicated for inflating/deflating only compression sleeve 630 rather than pairs of a variety of different sleeves. In the illustrative embodiment, pocket 634 is situated on main sleeve portion 632 closer to a top edge 644 thereof than to a bottom edge 646 thereof.

Although the invention has been described in detail with reference to certain illustrative embodiments, variations and modifications exist with the scope and spirit of this disclosure as described and defined in the following claims.

The invention claimed is:

1. A system for applying compression therapy to patient's limb, the system comprising a patient-support apparatus having a module-receiving cavity provided within a first portion of the patient support apparatus, the patient-support apparatus having a base above which the first portion is located and relative to which the first portion is raiseable and lowerable, a compression sleeve adapted to couple to the patient's limb, the sleeve being inflatable to compress the patient's limb, a conduit through which the sleeve is inflated, a pneumatic coupler provided on a second portion of the patient-support apparatus that is spaced from the first portion of the patient support apparatus and that is accessible to a caregiver for selective and releasable connection of the compression sleeve to the pneumatic coupler, the conduit being routed through an interior region of the patient support apparatus between the module-receiving cavity and the pneumatic coupler, and a compression module removably attachable to the patient-support apparatus and operable to inflate the compression sleeve through the conduit and the pneumatic coupler, at least a portion of the compression module being received in the module-receiving cavity such that an outlet port of the compression module pneumatically communicates with the conduit when the compression module is received within the module receiving cavity of the patient-support apparatus, the compression module being removable from the module-receiving cavity to permit the compression sleeve to be coupled to the compression module to permit the patient to ambulate away from the patient-support apparatus while wearing the compression sleeve and carrying the compression module, the conduit being left behind with the patient-support apparatus while the patient ambulates away from the patient-support apparatus, the compression module being operable to inflate the compression sleeve worn by the patient while the patient is ambulatory.

2. The system of claim 1, wherein the patient-support apparatus comprises a bed.

3. The system of claim 2, wherein the bed comprises a siderail and the module-receiving cavity is formed in the siderail.

4. The system of claim 3, wherein at least a portion of the interior region of the patient-support apparatus comprises an interior region of the siderail and at least a portion of the conduit is situated in the interior region of the siderail.

5. The system of claim 2, wherein the bed comprises a footboard and the module-receiving cavity is formed in the footboard.

6. The system of claim 5, wherein at least a portion of the interior region of the patient-support apparatus comprises an interior region of the footboard and at least a portion of the conduit is situated in the interior region of the footboard.

7. The system of claim 2, wherein the bed comprises a mattress and the module-receiving cavity is formed in the mattress.

8. The system of claim 7, wherein at least a portion of the interior region of the patient-support apparatus comprises an interior region of the mattress and at least a portion of the conduit is situated in the interior region of the mattress.

9. The system of claim 2, wherein the bed comprises a patient-support deck and the module-receiving cavity is formed in the patient-support deck.

10. The system of claim 9, wherein at least a portion of interior region of the patient-support apparatus comprises an interior region of the patient-support deck and at least a portion of the conduit is situated in the interior region of the patient-support deck.

11. The system of claim 9, wherein the patient-support deck has a first deck section and a second deck section, the first deck section is movable with respect to the second deck section, and the module-receiving cavity is formed in the first deck section.

12. The system of claim 1, wherein the patient-support apparatus has an inlet port in pneumatic communication with the conduit and the outlet port couples automatically to the inlet port when the compression module is inserted into the module-receiving cavity.

13. The system of claim 1, wherein the compression module comprises an electric circuit and a pressure generator, the patient-support apparatus comprises an electrical system, and the electrical system of the patient-support apparatus communicates with the electric circuit of the compression module when the compression module is received in the module-receiving cavity.

14. The system of claim 13, wherein the compression module has a first electrical connector, the patient-support apparatus has a second electrical connector, and the first electrical connector mates automatically with the second electrical connector when the compression module is inserted into the module-receiving cavity.

15. The system of claim 13, wherein the electrical system comprises a user input device configured to receive user inputs to command the operation of the compression module and the user input device is spaced from the module-receiving cavity.

16. The system of claim 13, wherein the pressure generator comprises a pump.

17. The system of claim 13, wherein the pressure generator comprises a compressor.

18. The system of claim 1, wherein the compression module is adapted to receive pressurized fluid from an external source of pressurized fluid and the compression module comprises a first valve having an opened position allowing pressurized fluid to flow through the conduit to inflate the compression sleeve and a closed position blocking the flow of pressurized fluid into the conduit.

19. The system of claim 1, wherein the patient-support apparatus comprises a mattress.

20. The system of claim 19, wherein the mattress comprises a core and a coverlet in which the core is situated, the module-receiving cavity is formed in the core, and the coverlet has an opening through which the module-receiving cavity is accessed.

21. The system of claim 20, wherein the interior region of the patient-support apparatus is provided within the coverlet, the conduit is routed at least partially through the interior region provided within the coverlet, and the pneumatic coupler is situated outside the interior region of the coverlet.

22. The system of claim 21, wherein the pneumatic coupler is adjacent a side panel of the coverlet.

23. The system of claim 22, wherein the pneumatic coupler is coupled to the side panel of the coverlet.

24. The system of claim 23, wherein the coverlet has a top panel, a bottom panel, and the side panel extends between the top and bottom panels, and the pneumatic coupler is coupled to the side panel near a foot end of the mattress.

25. The system of claim 23, wherein the coverlet and core have a head end, a foot end, and a pair of sides extending between the head and foot ends, the module-receiving cavity is closer to the head end than to the foot end, and the pneumatic coupler is closer to the foot end than to the head end.

26. The mattress of claim 20, further comprising a liner member having a first portion that lines the module-receiving cavity and having a second portion coupled to the coverlet.

27. The mattress of claim 26, wherein the first portion of the liner member has a space configured to receive at least a portion of the compression module therein.

28. The mattress of claim 26, wherein the second portion comprises a flange that couples to the coverlet adjacent the opening.

* * * * *

UNITED STATES PATENT AND TRADEMARK OFFICE

CERTIFICATE OF CORRECTION

PATENT NO. : 7,641,623 B2
APPLICATION NO. : 10/553086
DATED : January 5, 2010
INVENTOR(S) : Biondo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1121 days.

Signed and Sealed this

Sixteenth Day of November, 2010

David J. Kappos

David J. Kappos
*Director of the United States Patent and Trademark Office*